US008666716B2

(12) United States Patent
Yonekawa et al.

(10) Patent No.: US 8,666,716 B2
(45) Date of Patent: Mar. 4, 2014

(54) TRAFFIC SIMULATOR

(75) Inventors: Takashi Yonekawa, Mishima (JP); Kazuya Sasaki, Susono (JP); Masaaki Uechi, Hadano (JP); Masumi Kobana, Fuji (JP); Hironobu Kitaoka, Nissin (JP); Hiroko Mori, Aichi-gun (JP); Tatsuya Iwase, Aichi-gun (JP); Tetsuo Kurahashi, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 284 days.

(21) Appl. No.: 12/518,755

(22) PCT Filed: Jan. 11, 2008

(86) PCT No.: PCT/JP2008/050273

§ 371 (c)(1),
(2), (4) Date: Jun. 11, 2009

(87) PCT Pub. No.: WO2008/087905

PCT Pub. Date: Jul. 24, 2008

(65) Prior Publication Data

US 2010/0030541 A1 Feb. 4, 2010

(30) Foreign Application Priority Data

Jan. 15, 2007 (JP) ..... 2007-006310

(51) Int. Cl.
*G06G 7/48* (2006.01)

(52) U.S. Cl.
USPC ..... 703/8

(58) Field of Classification Search
USPC ..... 703/8
See application file for complete search history.

(56) References Cited

U.S. PATENT DOCUMENTS

2004/0176936 A1* 9/2004 Ohtsu et al. ..... 703/8

FOREIGN PATENT DOCUMENTS

| | | |
|---|---|---|
| JP | A-6-259407 | 9/1994 |
| JP | A-8-194882 | 7/1996 |
| JP | A-9-251596 | 9/1997 |
| JP | A-11-144183 | 5/1999 |
| JP | A-11-272158 | 10/1999 |
| JP | A-2000-132783 | 5/2000 |
| JP | A-2002-163749 | 6/2002 |
| JP | A-2002-260146 | 9/2002 |
| JP | A-2004-164315 | 6/2004 |
| JP | A-2004-199287 | 7/2004 |
| JP | A-2007-72809 | 3/2007 |

OTHER PUBLICATIONS

Li et al. "Research of Driving Safety Based on Human Body Biological Response" National Natural Sciences Foundation of China, 2006.*

Crundall et al. "Driving Experience and the Functional Field of View" Perception 1999 vol. 28 pp. 1075-1087.*

* cited by examiner

*Primary Examiner* — Saif Alhija
(74) *Attorney, Agent, or Firm* — Oliff PLC

(57) ABSTRACT

The present invention provides a traffic simulator which can simulate traffic conditions with high accuracy. Cautionary object searching portion searches for cautionary objects which a driver should heed when driving a vehicle model; recognized cautionary object selection portion and driver-recognized cautionary object selection portion, based on driver ability information set by data creation portion, select cautionary objects recognized by a driver from the found cautionary objects; and movement determination portion determines the movement of a vehicle model based on the selected cautionary objects.

7 Claims, 18 Drawing Sheets

FIG. 4

62

| CAUTIONARY OBJECT \ POSITION OF CAUTIONARY OBJECT | WITHIN 25m | WITHIN 50m | WITHIN 100m | IS BLOCKED | IS OUT OF VIEW |
|---|---|---|---|---|---|
| INTERSECTION | 0.50 | 0.52 | 0.95 | 0.57 | 0.60 |
| TRAFFIC LIGHTS | 0.50 | 0.52 | 0.57 | 0.60 | 0.70 |
| PRECEDING VEHICLE | 0.50 | 0.52 | 0.60 | 0.70 | 0.80 |
| ONCOMING VEHICLE | 0.50 | 0.60 | 0.70 | 0.80 | 0.90 |
| PEDESTRIAN | 0.50 | 0.70 | 0.80 | 0.90 | 1.00 |

REQUIRED LEVEL OF PROFICIENCY

FIG. 5

66

| EYESIGHT I \ LEVEL OF CONCENTRATION K | 1.0≧K>0.8 | 0.8≧K>0.6 | 0.6≧K>0.4 | 0.4≧K≧0.0 |
|---|---|---|---|---|
| I≧1.5 | 90 | 130 | 180 | 270 |
| 1.5>I≧1.0 | 100 | 150 | 200 | 300 |
| 1.0>I≧0.7 | 110 | 160 | 220 | 330 |
| 0.7>I | 120 | 180 | 240 | 360 |

REQUIRED TIME FOR RECOGNITION (ms)

FIG. 6

70

| LEVEL OF LEEWAY Y \ CONTINUOUS TIME T | 1 MINUTE | 5 MINUTE | 15 MINUTE | 30 MINUTE |
|---|---|---|---|---|
| 0.0≦Y<0.25 | 0.8 | 0.7 | 0.5 | 0.3 |
| 0.25≦Y<0.50 | 0.9 | 0.8 | 0.6 | 0.4 |
| 0.50≦Y<0.75 | 1.0 | 0.9 | 0.8 | 0.6 |
| 0.75≦Y≦1.00 | 1.0 | 1.0 | 1.0 | 1.0 |

LEVEL OF CONCENTRATION

TRAFFIC SIMULATOR

BACKGROUND OF THE INVENTION

1. Field of the Invention

The present invention relates to a traffic simulator, and in particular, a traffic simulator that reproduces the movement of vehicles by a computer, and simulates traffic states, such as traffic flow and congestion, the occurrence of accidents, and the like.

2. Background Art

When designing a road traffic system, it is very important to evaluate in advance which locations should be improved and in what manner to achieve the effect of preventing traffic congestion and the like. To this end, traffic simulators have been proposed in which the movement of each individual vehicle is reproduced by a computer, and traffic conditions, such as traffic flow and congestion, and the occurrence of accidents, and the like, are simulated (for example, see Patent Documents 1 and 2 below).

In this type of traffic simulator, cautionary objects within a predetermined range from a vehicle, such as traffic lights, preceding vehicles, oncoming vehicles and the like which a driver of a vehicle should heed when driving on a road, are recognized, and after judging, in order, what color the traffic lights are, whether the vehicle will impact with a preceding vehicle or impact with an oncoming vehicle, and the like, the movement of the vehicle is determined.

Patent Document 1: Japanese Patent Application Laid-Open (JP-A) No. 11-144183

Patent Document 2: Japanese Patent Application Laid-Open (JP-A) No. 8-194882

DESCRIPTION OF THE INVENTION

Problem to be Solved by the Invention

In practice, the time for respective drivers to recognize a cautionary object differs according to their abilities, such as eyesight and driving proficiency, and therefore the movement of each vehicle differs according to the abilities of their respective drivers.

However, the traffic simulators disclosed in the above patent documents are problematic, in that they do not take into account the abilities of the drivers of each vehicles when simulating traffic conditions, and therefore are not necessarily highly accurate simulators.

The present invention is intended to address the above problem, and takes as an aim to provide a traffic simulator that can simulate traffic conditions with high accuracy.

Means for Solving the Problem

To address the above aim, the invention of claim 1 provides a traffic simulator, comprising: a setting portion that, when a vehicle model, which is a model of a vehicle, is virtually driven on a road and traffic conditions are simulated, sets ability information representing abilities related to the driving of a driver of a vehicle model; a storage portion that stores space arrangement data representing the arrangement of the vehicle model in a virtual road space; a searching portion that searches the road space, which is represented by the space arrangement data stored in the storage portion, for cautionary objects that should be heeded by the driver when driving the vehicle model; a selection portion that selects cautionary objects recognized by the driver from the cautionary objects found by the searching portion, based on ability information of the driver set by the setting portion; and a determination portion that determines the movement of the vehicle model based on the cautionary objects selected by the selection portion.

In the invention of claim 1, when a vehicle model, which is modeled on a vehicle, is made to drive virtually on a road and traffic conditions are simulated, ability information representing abilities relating to the driving of the driver is set by a setting portion, and space arrangement data, in which a vehicle model is arranged in a virtual road space, is stored in a storage portion.

Thus, in the present invention, a searching portion searches a road space represented by space arrangement data stored in a space arrangement data storage portion, and finds therein cautionary objects that should be heeded by a driver driving a vehicle model and a selection portion selects cautionary objects recognized by the driver from the cautionary objects found by the searching portion, based on ability information of the driver set by the setting portion, and a determination portion determines the movement of the vehicle model based on the cautionary objects selected by the selection portion.

Thereby, in claim 1 of the present invention, cautionary objects that should be heeded by a driver driving a vehicle model are found, and based on set ability information of the driver, cautionary objects recognized by the driver are selected from the found cautionary objects, and based on the selected cautionary objects, the movement of the vehicle model is determined, and thereby a traffic simulator having a high accuracy can be achieved.

Further, in the present invention, as with the invention recited in claim 2, the ability information may include information representing a level of proficiency of the driver; the storage portion may further store, for each predetermined cautionary object, required level of proficiency information representing the level of proficiency required for the driver to recognize the cautionary object; and the selection portion may select, as cautionary objects recognized by a driver, those cautionary objects found by the searching portion whose required level of proficiency, represented by the level of proficiency information stored in the storage portion, is less than or equal to the level of driving proficiency of the driver set by the setting portion.

Further, in the invention of claim 2, as with the invention recited in claim 3, the required level of proficiency information may represent a level of proficiency required by the driver to recognize a cautionary object based on at least one of the distance from a vehicle model to the cautionary object, whether the cautionary object is blocked, or whether the cautionary object is within the driver, field of view; and the selection portion may select, as cautionary objects recognized by a driver, from the cautionary objects found by the searching portion, those cautionary objects having a required level of proficiency less than or equal to the level of driving proficiency of the driver set by the setting portion, the required level of proficiency being based on at least one of the distance from a vehicle model to the cautionary object, whether the cautionary object is blocked, or whether the cautionary object is within the driver's field of view.

Moreover, in the present invention, as with the invention recited in claim 4, the ability information may further include at least one of information representing the driver's eyesight or information representing the driver's level of concentration; the storage portion may further store, for each predetermined cautionary object, recognition time information representing the time required for the driver to recognize the cautionary object according to at least one of eyesight or level of concentration; and the selection portion, based on the recognition time information stored in the storage portion, may obtain the required time for the driver to recognize a cautionary object found by the searching portion according to at least one of the eyesight or level of concentration of the driver set by the setting portion, add together the required times in a predetermined order of priority or in a random order, and select as cautionary objects recognized by a driver those cautionary objects which are added within a movement determination time required for the driver to recognize cautionary objects and for the movement of the vehicle model to be determined.

Further, the invention of claim 4, as with the invention recited in claim 5, may be further provided with a modification portion that, by obtaining the amount of the movement determination time that remains after deducting the added time, obtains a level of leeway of the driving of the driver, and modifies the information representing a level of concentration such that when the driver has a low level of leeway the concentration of the driver is decreased accordingly to that extent.

Effect of the Invention

As described above, the present invention has the excellent effect of simulating traffic conditions with high accuracy, since it finds cautionary objects that should be heeded by a driver of a vehicle model when driving, and based on set driver ability information, selects cautionary objects recognized by a driver from the found cautionary objects, and determines the movement of a vehicle model based on the selected cautionary objects.

BRIEF EXPLANATION OF THE DRAWINGS

FIG. 4 is a schematic view showing an example of the data structure of the required level of proficiency information according to the present embodiment.

FIG. 5 is a schematic view showing an example of the data structure of the recognition time information according to the present embodiment.

FIG. 6 is a schematic view showing an example of the data structure of the continuous concentration level information according to the present embodiment.

BEST MODE FOR IMPLEMENTING THE INVENTION

An embodiment of the present invention is explained below in detail with reference to the drawings.

In the traffic simulator according to the present embodiment, while simulating the movement of vehicles, the movement of the vehicles is displayed on, for example, a display device (not shown), or the results of the simulation are recorded on a paper or the like by printing.

Figure 1:
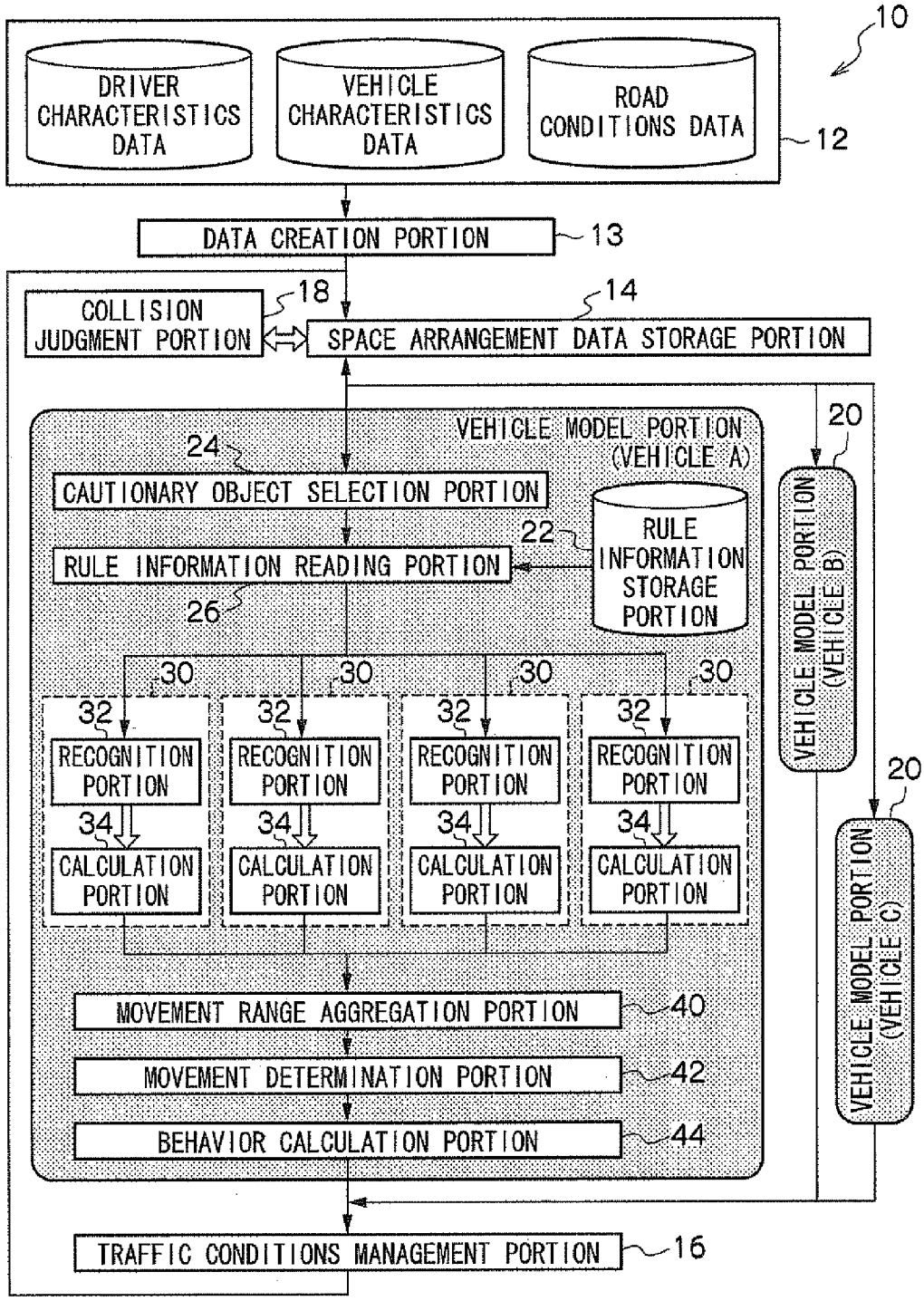
FIG. 1 is a block drawing showing the structure of a traffic simulator according to the present embodiment.

FIG. 1 is a block diagram showing the functional structure of traffic simulator 10 according to the present embodiment.

Traffic simulator 10 is provided with a data storage portion 12, a data creation portion 13, a space arrangement data storage portion 14, a vehicle model portion 20, a traffic conditions management portion 16, and a collision judgment portion 18.

Data storage portion 12 stores in advance various data necessary for simulating road conditions with a computer.

The above various data of data storage portion 12 according to the present embodiment includes, for example, road conditions data which represents the simulated road conditions, vehicle characteristics data which represents characteristics of a vehicle, and driver characteristics data which represents abilities related to the driving of a driver who drives a vehicle.

Figure 2:
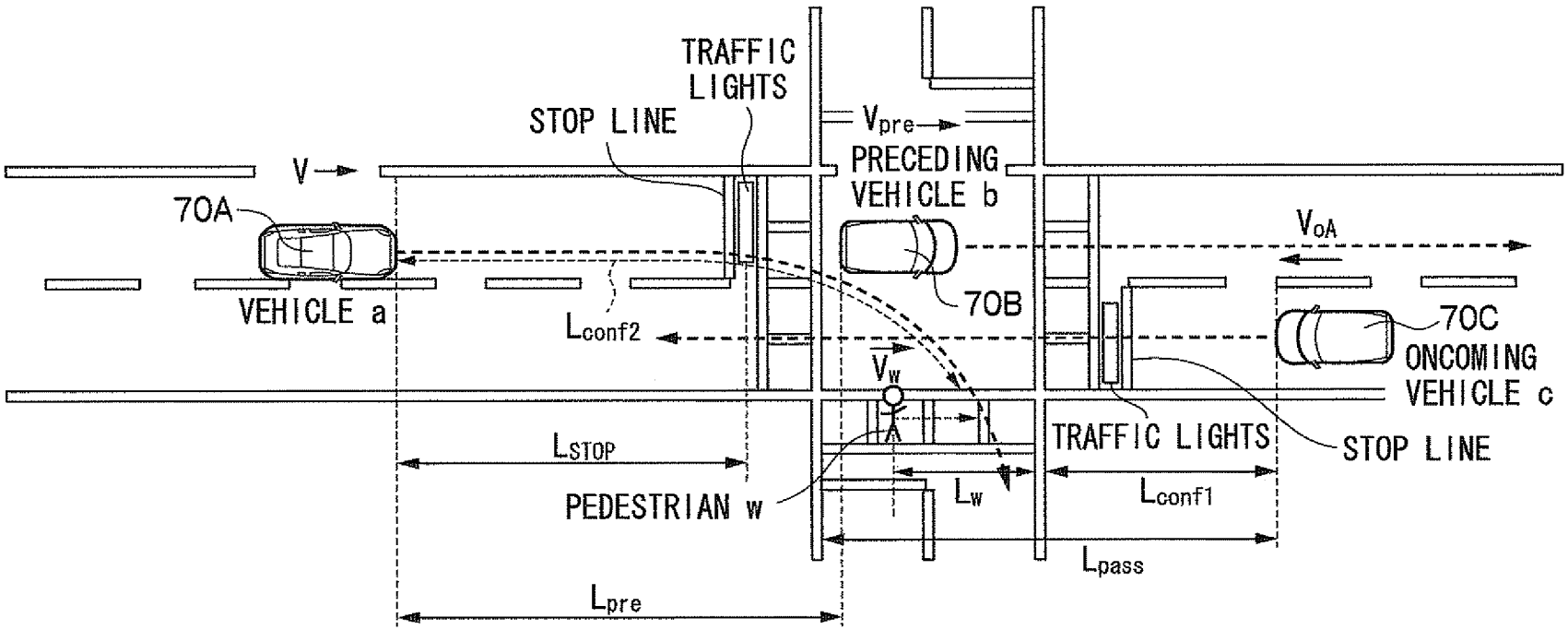
FIG. 2 is a drawing showing an example of simulated road conditions according to the present embodiment.

The road conditions data according to the present embodiment includes, for example, data representing road conditions such as those shown in FIG. 2, where a vehicle a, which is to turn right at an intersection having traffic lights, a vehicle b, which drives in the same lane as vehicle a and precedes vehicle a, an opposing vehicle c, which drives in a lane opposing that of vehicle a, and a pedestrian w, who crosses a crossing of the intersection, are arranged. Further, the speed limit of each of the above lanes is set to $V_{max}$.

In practice, the acceleration and deceleration abilities of a vehicle differ according to its weight, engine displacement and the like. Therefore, the vehicle characteristics data according to the present embodiment includes a maximum acceleration speed $A_{max}$ when accelerating, and a maximum deceleration speed $A_{min}$ when decelerating, for each of vehicle a, preceding vehicle b, and opposing vehicle c.

Further, drivers of vehicles differ with respect to their physical abilities such as eyesight, as well as driving proficiency and level of concentration, and the acceleration and deceleration characteristics of a vehicle used when driving also differs according to, for example, the personality of the driver. As a result, the driver characteristics data according to the present embodiment as described above includes data representing ability information such as driver eyesight, driving proficiency, level of concentration and so on, as well as a maximum acceleration speed $A'_{max}$ and a maximum deceleration speed $A'_{min}$ used by each driver, for each of vehicle a, preceding vehicle b, oncoming vehicle c, and so on, respectively.

Based on the various data stored in data storage portion 12, data creation portion 13 creates space arrangement data in which vehicle models, which are models of vehicles, are arranged in a virtual road space, and space arrangement data is stored in space arrangement data storage portion 14. Further, data creation portion 13 relates ability information of drivers, such as eyesight, driving proficiency, level of concentration and so on, to respective vehicle models, and sets each of these by storing them in space arrangement data storage portion 14.

Thus, space arrangement data storage portion 14 stores space arrangement data and ability information created by data creation portion 13, as well as a maximum acceleration speed $A'_{max}$ and a maximum deceleration speed $A'_{min}$ for each driver.

Vehicle model portion 20 calculates the behavior of each vehicle model based on the space arrangement data stored in space arrangement data storage portion 14.

Traffic simulator 10 according to the present invention comprises vehicle model portions 20A, 20B, 20C, etc. which respectively correspond to vehicle a, preceding vehicle b, oncoming vehicle c, and so on. Based on vehicle model portions 20A, 20B, 20C, etc., the behavior of each vehicle model modeled on each vehicle is calculated. Further, in order to avoid confusion, the following explanation only relates to the case of the three vehicles of model portions, 20A, 20B and 20C; however, this does not limit the number of vehicles that may be simulated. In the following, the letters A, B and C are used to distinguish vehicle model portions 20A, 20B and 20C; however, when it is not necessary to distinguish between each of the vehicle model portions, the letters A, B and C may be omitted.

As shown in FIG. 1, vehicle model portion 20 includes rule information storing portion 22, cautionary object selection portion 24, rule information reading portion 26 and movement range calculation portion 30.

Rule information storing portion 22 stores in advance rule information representing rules for calculating a selectable movement range for movement of a vehicle model when a cautionary object is recognized by the driver thereof, with respect to each cautionary object which should be heeded when driving a vehicle on a road.

In traffic simulator 10 according to the present embodiment, as the above rule information, a selectable movement range is calculated using a previously predetermined movement range calculation rule program, for each of the above cautionary objects. In order to avoid confusion, traffic simulator 10 according to the present embodiment only has four types of cautionary objects: traffic lights, oncoming vehicles, preceding vehicles and pedestrians; however, the number of cautionary objects is not limited thereby.

In traffic simulator 10 according to the present embodiment, four movement range calculation rule programs are stored in advance in rule information storing portion 22; namely, a traffic light movement range calculation rule program for calculating the movement range of a vehicle model when a set of traffic lights is recognized, an oncoming vehicle movement range calculation rule program for calculating the movement range of a vehicle model when an oncoming vehicle is recognized, a preceding vehicle movement range calculation rule program for calculating the movement range of a vehicle model when a preceding vehicle is recognized, and an oncoming vehicle movement range calculation rule program for calculating the movement range of a vehicle model when an oncoming vehicle is recognized.

Cautionary object selection portion 24 models the manner in which a driver recognizes road conditions. Based on the positional relationships between objects on a road, such as each vehicle model and each set of traffic lights arranged in a road space and represented by space arrangement data stored in space arrangement data storage portion 14, and driver ability information, cautionary object selection portion 24 selects a cautionary object recognized by a driver who drives a vehicle model, which is an object of behavior calculation.

Rule information reading portion 26 reads, from rule information storing portion 22, a movement range calculation rule program corresponding to a cautionary object selected by cautionary object selection portion 24.

Based on the movement range calculation rule program read by rule information reading portion 26, movement range calculation portion 30 calculates a selectable movement range for a movement of a vehicle model.

Traffic simulator 10 according to the present embodiment implements each movement range calculation rule program in parallel, and is provided with plural movement range calculation portions 30 corresponding to each movement range calculation rule program, such that each movement range can be calculated. Traffic simulator 10 according to the present embodiment includes four movement range calculation portions 30 corresponding to respective movement range calculation rule programs; however, each movement range calculation rule program may be carried out sequentially at a single movement range calculation portion 30, and the respective movement ranges calculated accordingly. Thus, it is not necessary to provide a separate movement range calculation portion 30 corresponding to each movement range calculation rule program.

As shown in FIG. 1, each movement range calculation portion 30 according to the present embodiment includes an identification portion 32 and a calculation portion 34.

Identification portion 32 identifies necessary parameters for calculating movement ranges based on the positional relationships between each vehicle model, each object on a road and the like, which are arranged in a road space and represented by space arrangement data stored in space arrangement data storage portion 14.

Calculation portion 34 calculates, as a selectable movement range of a vehicle model, an acceleration/deceleration speed range that accelerates or decelerates a vehicle model, by using the parameters identified by identification portion 32 and implementing movement range calculation rule programs. In the present embodiment, when the acceleration/deceleration speed is a positive value, it represents an acceleration that accelerates the vehicle model, and when the acceleration/deceleration speed is a negative value, it represents a deceleration that decelerates the vehicle model. In the present embodiment, the above explanation relates to calculating an acceleration/deceleration speed as a selectable movement range; however, for example, a desired speed of a vehicle model, a position to which the vehicle model is to move, and the like, may also be calculated as the selectable movement range.

Vehicle model portion 20 according to the present embodiment includes movement range aggregation portion 40, movement determination portion 42 and behavior calculation portion 44.

Movement range aggregation portion 40 acquires each selectable acceleration/deceleration speed range calculated by each movement range calculation portion 30, and obtains an aggregated acceleration/deceleration speed range from the plural acceleration/deceleration speed ranges.

Movement determination portion 42 simulates the manner in which a driver operates a vehicle. Movement determination portion 42 according to the present embodiment determines, from the aggregated acceleration/deceleration speed range obtained by movement range aggregation portion 40, a movement of a vehicle model such that the vehicle model may advance as fully as possible.

Behavior calculation portion 44 calculates the behavior of a vehicle model based on the movement determined by movement determination portion 42.

Traffic state management portion 16 updates the position of each vehicle model positioned in the road space represented by space arrangement data stored in space arrangement data storage portion 14, based on the calculation result of each behavior calculation portion 44. Further, traffic state management portion 16 controls the signaling of traffic lights positioned in the road space, and controls the updating of the position of a pedestrian w.

Collision judgment portion 18 compares the positional relationships of vehicle models, objects on a road, and the like, which are positioned in the road space represented by space arrangement data stored in space arrangement data storage portion 14, and thereby judges whether a collision has occurred between a vehicle model and a object on a road, or whether a collision has occurred between vehicle models. Information representing a vehicle weight and level of collision safety and the like may also be stored in advance as vehicle characteristics data, and collision judgment portion 18 may also calculate the state of damage to a vehicle or vehicle occupant due to a collision, based on information representing the speed of a colliding vehicle model, its weight, level of safety, and the like.

Figure 3:
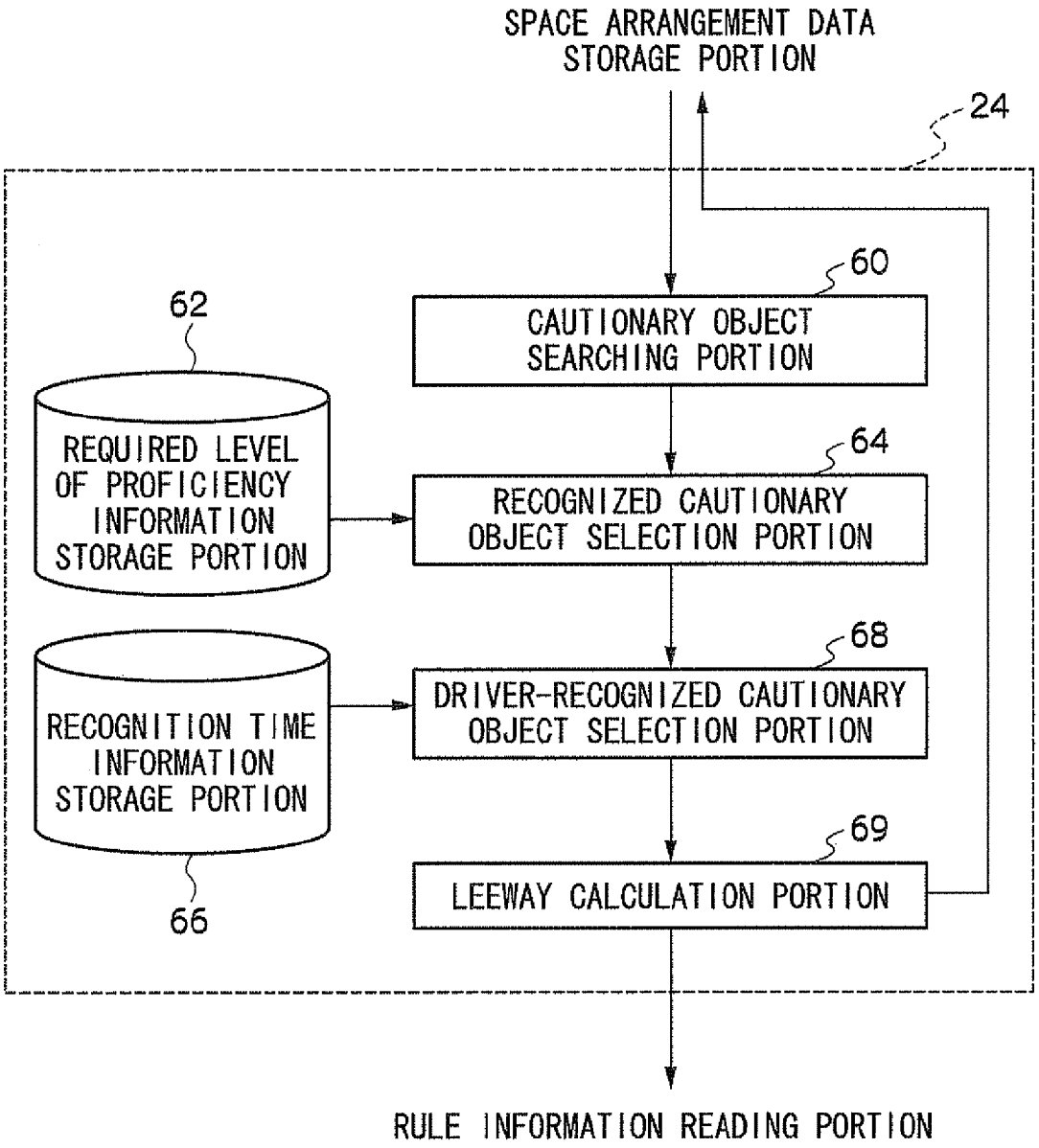
FIG. 3 is a block drawing showing the detailed structure of the cautionary object selection portion according to the present embodiment.

FIG. 3 is a block drawing showing the detailed structure of the cautionary object selection portion 24 according to the present embodiment.

As shown in this figure, cautionary object selection portion 24 includes cautionary object searching portion 60, required level of proficiency information storage portion 62, recognized cautionary object selection portion 64, recognition time information storage portion 66, driver-recognized cautionary object selection portion 68, and leeway calculation portion 69.

Cautionary object searching portion 60 searches a road space represented by space arrangement data stored in space arrangement data storage portion 14 for cautionary objects which a driver should heed when driving a vehicle model safely, and creates a cautionary object candidate list from the located cautionary objects which a driver should heed. As the above cautionary objects which a driver should heed, cautionary object searching portion 60 according to the present embodiment searches cautionary objects existing within a predetermined distance (100 meters in this explanation) from the vehicle model whose behavior is being calculated, and creates the cautionary object candidate list accordingly.

Required level of proficiency information storage portion 62 stores, in advance, and with respect to each type of cautionary object, required level of proficiency information, based on the positional relationship between a vehicle model and the cautionary object, representing a level of proficiency required of a driver of a vehicle model to recognize the cautionary object.

FIG. 4 is a schematic view showing an example of the data structure of the required level of proficiency information. In this figure, "BLOCKED" indicates that, for example, when there are plural cautionary objects, a vehicle model whose behavior is being calculated is at a position at which the positional relationships between the vehicle model and cautionary objects are such that, from the vehicle model, one cautionary object is blocked by another cautionary object; while "OUT OF VIEW" indicates that for example, a vehicle model whose behavior is being calculated is at a position at which the position of a cautionary object is such that it cannot be seen from the vehicle model due to a wall or the like. Further, in the present embodiment the level of proficiency of a driver is set to be within a range of from 0 to 1.0, according to the driving experience of the driver, where a higher value indicates a higher level of proficiency. The levels of proficiency required in order to recognize cautionary objects shown in this figure, and the ratios of drivers driving the vehicle models who can recognize cautionary objects based on the positional relationships between the vehicle models and cautionary objects, are based on information obtained from experiments involving actual vehicles, computer simulations, or the like.

Recognized cautionary object selection portion 64 selects objects recognized by a driver from the cautionary objects of the cautionary object candidate list created by cautionary object searching portion 60. In traffic simulator 10 according to the present embodiment, if the positional relationship between a vehicle model and a cautionary object is such that the cautionary object is out of view, recognized cautionary object selection portion 64 selects, as cautionary objects recognized by a driver, cautionary objects that have an out of view required level of proficiency that is equal to or lower than the level of proficiency of the driver. If the positional relationship between a vehicle model and a cautionary object is such the cautionary object is blocked, recognized cautionary object selection portion 64 selects, as cautionary objects recognized by a driver, cautionary objects that have a required level of proficiency when blocked that is equal to or lower than the level of proficiency of the driver. In cases other than a cautionary object being out of view or blocked, recognized cautionary object selection portion 64 selects, as cautionary objects recognized by a driver, cautionary objects that have a required level of proficiency, based on the distance between the vehicle model and the cautionary object, less than or equal to the level of proficiency of the driver.

Recognition time information storage portion 66, stores in advance recognition time information representing the time required for a driver to recognize a cautionary object, with respect to each cautionary object, such as an oncoming vehicle, a preceding vehicle, a set of traffic lights, a pedestrian and the like.

FIG. 5 is a schematic view showing an example of the data structure of recognition time information set with required times for a driver to recognize an oncoming vehicle.

As shown in this figure, required times for a driver to recognize an oncoming vehicle are stored in the recognition time information according to the eyesight and concentration level of the driver. The times shown in FIG. 5 are indicated in milliseconds (ms). The times required to recognize a cautionary object indicated in this figure are based on times for a driver to recognize a cautionary object according to the eyesight and level of concentration of the driver obtained through experimentation using actual vehicles, computer simulations or the like.

Driver-recognized cautionary object selection portion 68, based on recognition time information stored in recognition time information storage portion 66, obtains, according to the eyesight and level of concentration of a driver, required times for recognizing the cautionary objects selected by driver-recognized cautionary object selection portion 64, adds the required times together in a predetermined priority order, and subsequently selects, as cautionary objects recognized by a driver, those cautionary objects which are added within a predetermined movement determination time. The above priority order is, for example, in order of closest distance from vehicle to cautionary object, or it may be fixed, for example, in the following order: sets of traffic lights, preceding vehicles, oncoming vehicles, pedestrians, and so on. The required times may also be added in a random order. The above movement determination time represents time required for a vehicle model to recognize a cautionary object and determine movement. Movement determination times are based on times for a driver to determine a vehicle movement after recognizing a cautionary object obtained through experiments with actual vehicles, computer simulations, or the like. In the present embodiment, a movement determination time is, for example 1.5 seconds.

Leeway calculation portion 69 calculates a level of leeway with respect to a driver's driving by obtaining the amount of movement determination time that remains after deducting the added time. The lower the level of leeway, the more the level of concentration of a driver is reduced, by modifying information representing a level of concentration. Further, leeway calculation portion 69 of the present embodiment, as shown in FIG. 6, may store in advance continuous concentration information that determines the level of concentration for a driver, based on a level of leeway range and a continuous time over which each level of leeway range is maintained, obtain a level of concentration from the continuous concentration information according to the level of leeway range and the continuous time over which each level of leeway range is maintained, and update the level of concentration of a driver based on the obtained level of concentration. In the present embodiment, the level of concentration is set to be within a range of from 0 to 1.0 according to the level of concentration of a driver, where a larger value indicates a higher level of concentration. The levels of concentration indicated in the figure are based on levels of driver concentration maintained over a continuous time with respect to each level of leeway, obtained through experimentation using actual vehicles, computer simulations and the like.

Next, the operation of traffic simulator 10 will be explained with reference to FIG. 7, upon reproducing the behavior of vehicles with a computer and implementing the above simulation.

Figure 7:
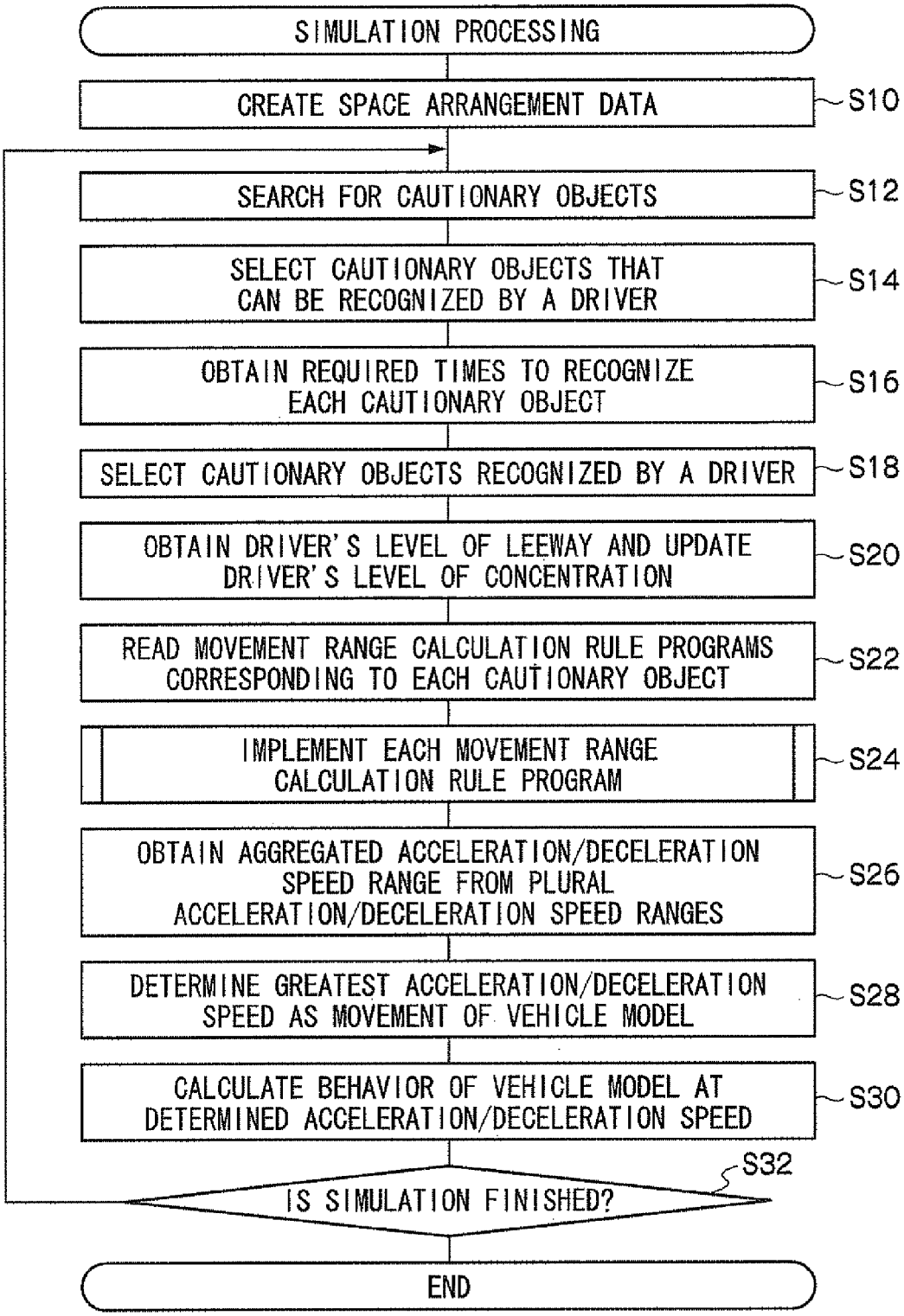
FIG. 7 is a flowchart showing the flow of simulation processing according to the present embodiment.

In step S10 of FIG. 7, as described above, data creation portion 13 creates initial space arrangement data, representing the state of virtual arrangement in a road space of vehicle models 70A-70C, which are models of vehicle a, preceding vehicle b and oncoming vehicle c exemplified in FIG. 2, and stores the space arrangement data in space arrangement data storage portion 14. Also in step S10, for each vehicle model 70A-70C, a maximum acceleration speed $A_{max}$ and a maximum deceleration speed $A_{min}$ based on respective vehicle characteristics data stored in data storage portion 12 are related to the respective vehicles and stored in space arrangement data storage portion 14. Also in step S10, for each vehicle model 70A-70C, ability information representing driving abilities of a driver of the vehicle model, such as a maximum acceleration speed $A'_{max}$ and a maximum deceleration speed $A'_{min}$ of the driver, as well as driver eyesight, driving level of proficiency, level of concentration, and the like, based on respective ability information stored in data storage portion 12, are related to the respective drivers and stored in space arrangement data storage portion 14. In the present embodiment, the level of proficiency of a driver with 20 or more years driving experience (a driver having the highest level of proficiency) is set as 1.0; the level of proficiency of a driver with less than 20 years experience but having 5 or more years experience is set as 0.9; the level of proficiency of a driver with less than 5 years experience but having 1 or more years experience is set as 0.8, the level of proficiency of a driver with less than 1 year's experience but 3 months or more of driving experience is set as 0.7, and the level of proficiency of a driver with less than 3 months experience and having held their driving license for less than 3 months is set as 0.6.

In the next step S12, as described above, cautionary object searching portion 60 searches for cautionary objects which should be heeded when a driver is to safely drive a vehicle model, and creates a cautionary objects candidate list of the searched cautionary objects which should be heeded.

In the next step S14, as described above, recognized cautionary object selection portion 64 selects cautionary objects recognized by a driver from the above cautionary objects candidate list created in step S12.

In the next step S16, as described above, driver-recognized cautionary object selection portion 68 obtains required times for a driver to recognize the cautionary objects selected in step S14, and in the next step S18, adds together the required times in a predetermined priority order, and those cautionary objects which are added within a predetermined movement determination time are selected as cautionary objects recognized by the driver.

Figure 8:
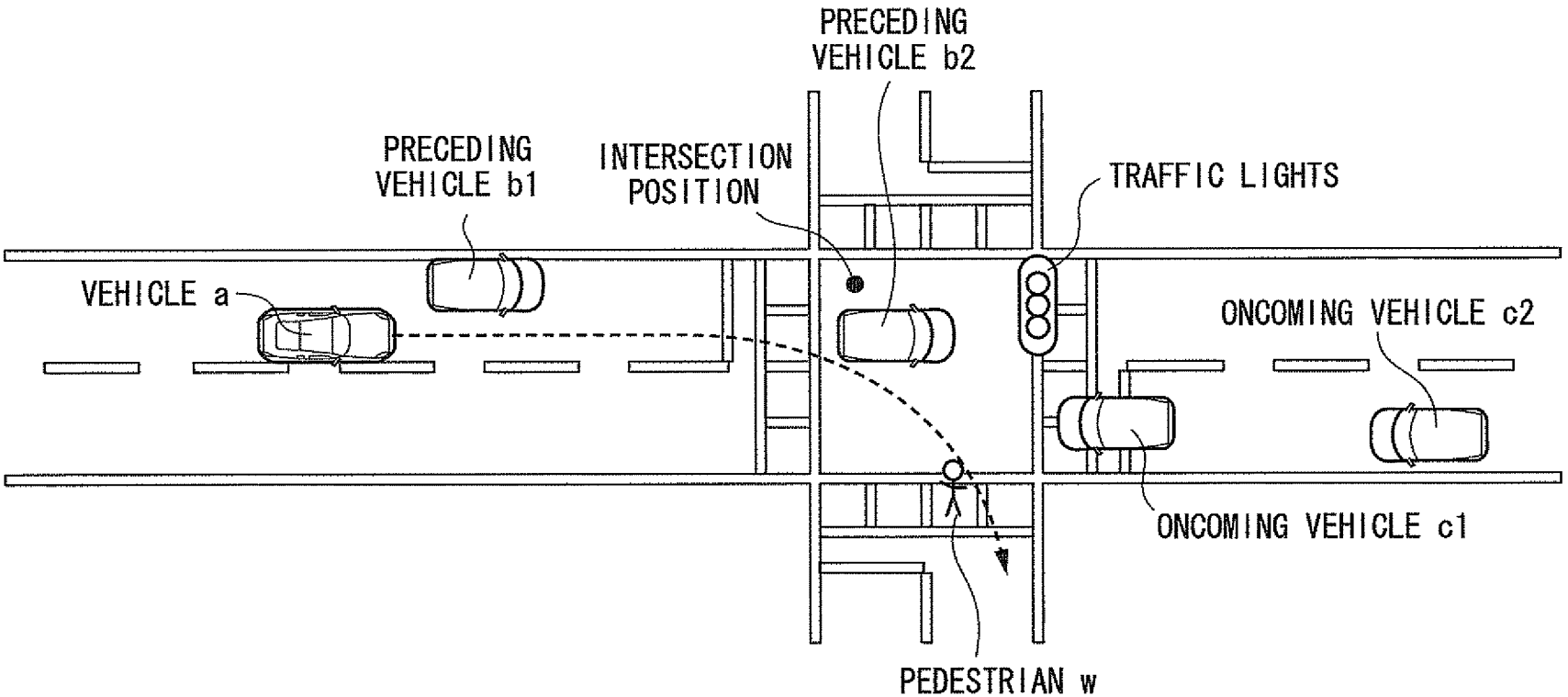
FIG. 8 is a drawing showing another example of simulated road conditions.
Figure 9:
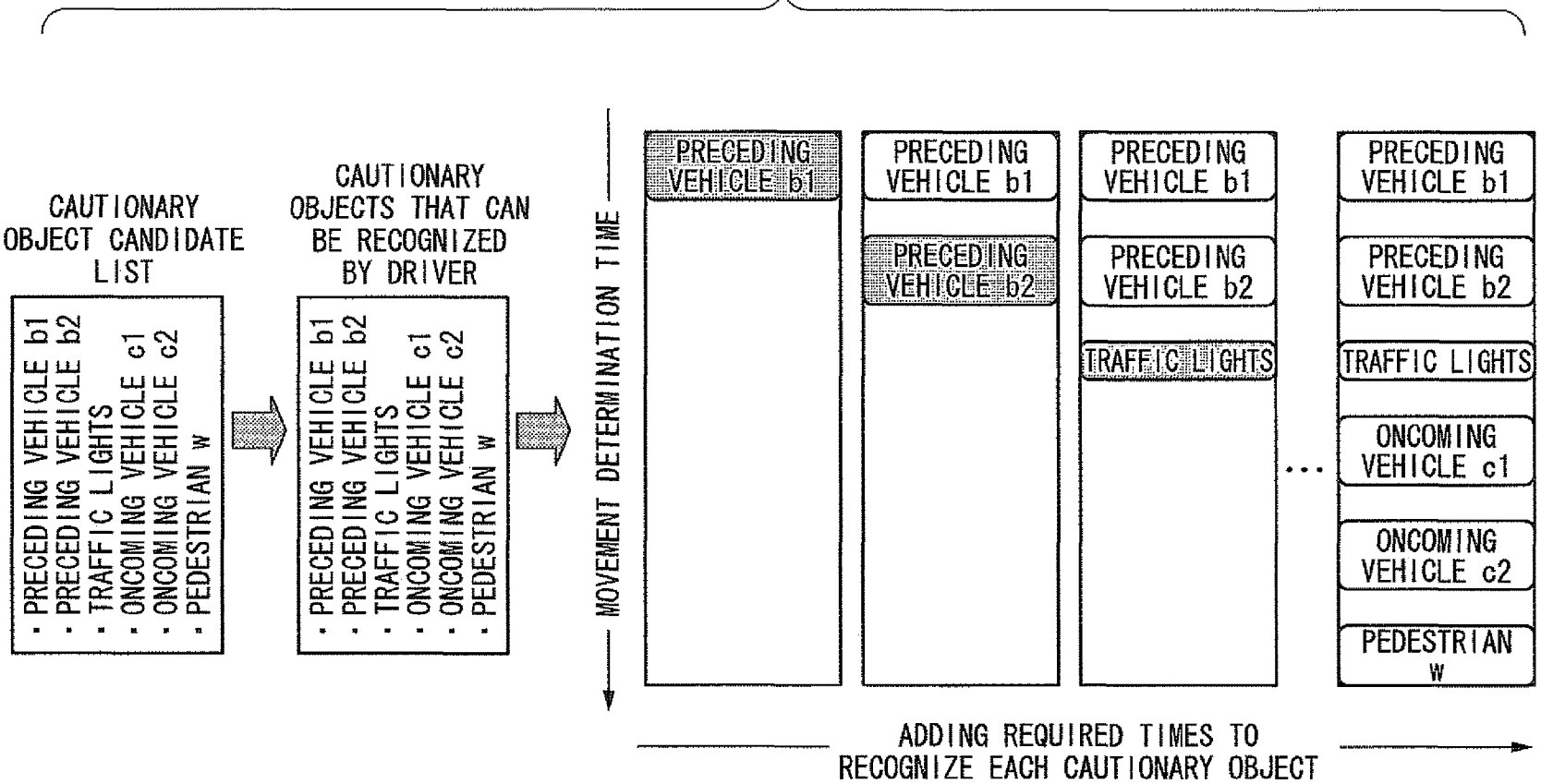
FIG. 9 is a schematic view that accompanies an explanation of the flow of processing when cautionary objects recognized by a driver having a high level of proficiency, good eyesight, and a high level of concentration are selected, according to the present embodiment.

In other words, for example, if the positional relationships of vehicle models arranged in a road space and physical objects on the road are as shown in FIG. 8, cautionary objects which a driver should heed when safely driving a vehicle model, such as preceding vehicles b1 and b2, oncoming vehicles c1 and c2, pedestrian w, traffic lights and the like, are located by the searching and a cautionary objects candidate list as shown in FIG. 9 is created accordingly.

Then, supposing the level of proficiency of the driver driving vehicle a to be high (their level of proficiency is 1.0), all of the cautionary objects are selected as cautionary objects which can be recognized by the driver, as shown in FIG. 9.

Figure 10:
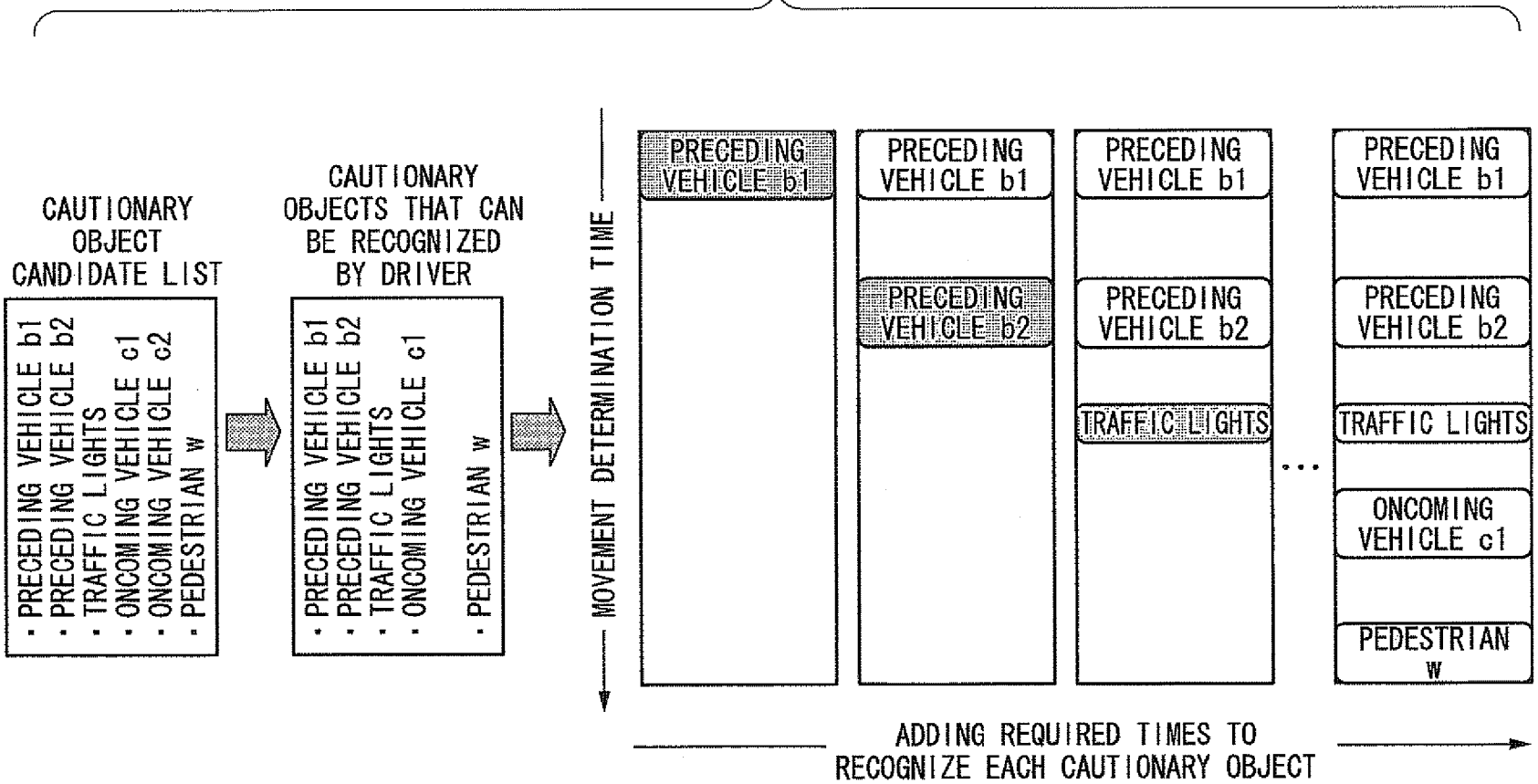
FIG. 10 is a schematic view accompanying an explanation of the flow of processing when cautionary objects recognized by a driver having a low level of proficiency, good eyesight, and a high level of concentration are selected, according to the present embodiment.

However, supposing the level of proficiency of the driver driving vehicle a to be low (their level of proficiency is 0.6), then, as shown in FIG. 10, oncoming vehicle c2 which is distance from vehicle a is not selected as a cautionary object which can be recognized by the driver.

In this way, in traffic simulator 10 according to the present embodiment, a state of recognition of cautionary objects can be reproduced according to a driver's level of driving proficiency.

Further, supposing the driver's eyesight to be good, and their level of concentration to be high, (their eyesight is 1.5 or greater, and their level of concentration is 1.0), then, as shown in FIG. 9, since the time required to recognize a cautionary object is short, a greater number of cautionary objects can be recognized.

Figure 11:
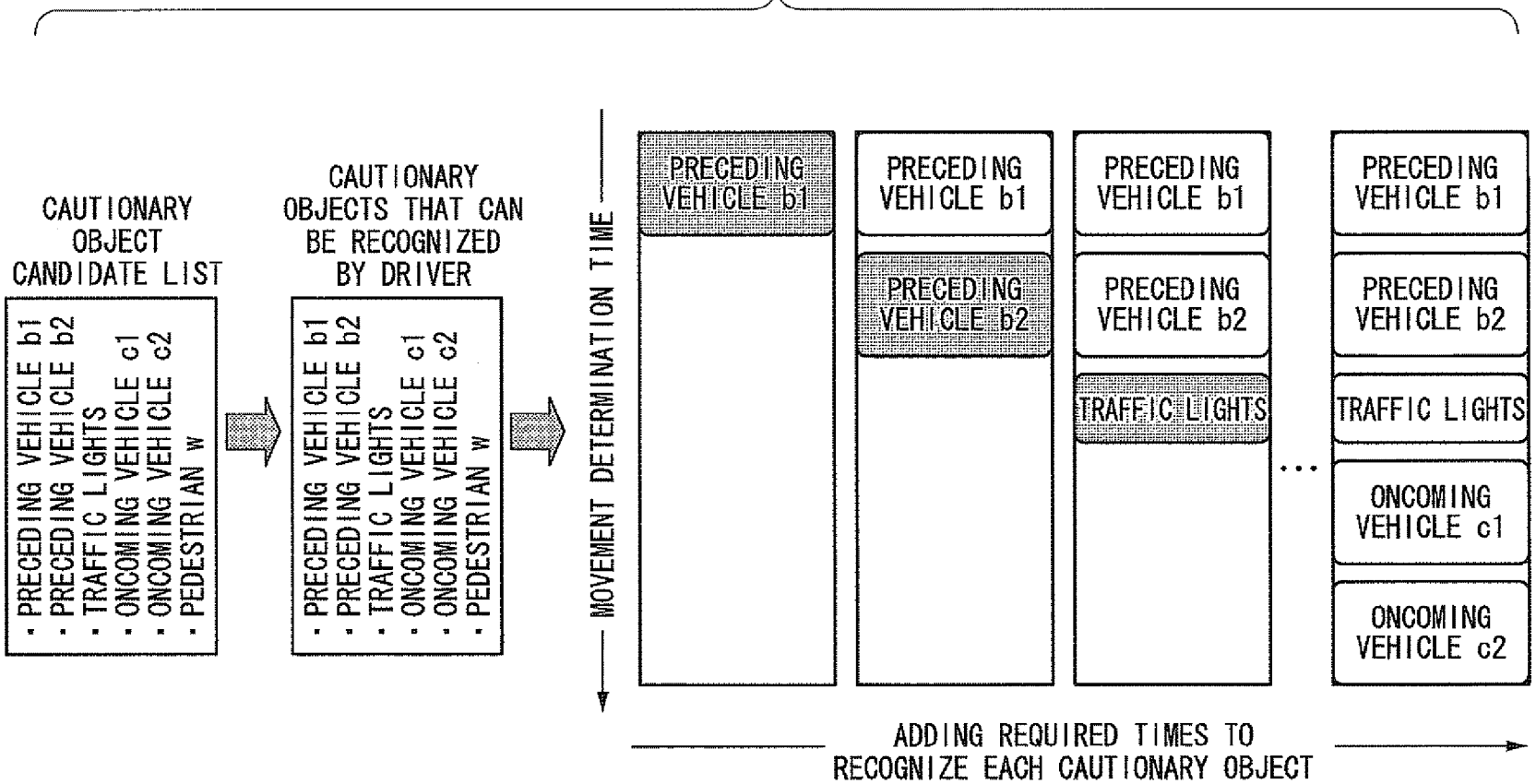
FIG. 11 is a schematic view accompanying an explanation of the flow of processing when cautionary objects recognized by a driver having a high level of proficiency, poor eyesight, and a low level of concentration are selected, according to the present embodiment.

However, supposing the driver's eyesight to be poor, and their level of concentration to be low (their eyesight is less than 0.7, and their level of concentration is 0.4 or less), then, as shown in FIG. 11, since the time required to recognize a cautionary object is longer, only some of the cautionary objects can be recognized.

In this way, in traffic simulator 10 according to the present embodiment, a state of recognition of cautionary objects can be reproduced according to a driver's eyesight and/or level of concentration.

Further, since, when a driver drives a car in practice, they move their line of sight in order to recognize multiple cautionary objects, a certain period of time passes between recognition of each cautionary object, and this period of time between recognition of each cautionary object tends to be averaged out between the number of cautionary objects. Thus, in FIGS. 9-11, the space of time between recognition of each respective cautionary object is shown to be averaged out.

In the next step S20, as described above, leeway calculation portion 69 obtains a level of leeway for the driving of a driver, further obtains, from continuous concentration information, a level of concentration according to a continuous time over which the level of leeway range is maintained, and updates the driver's level of concentration with the obtained level of concentration.

In this way, in the traffic simulator 10 according to the present embodiment it is possible to reproduce a situation in which, if there are a large number of cautionary objects recognized by a driver when driving, and if a state of no leeway in driving continues for a long time, a driver's level of concentration decreases due to tiredness, and the time required to recognize cautionary objects increases.

In the next step S22, rule information reading portion 26 reads from rule information storing portion 22 a movement range calculation rule program according to a cautionary object selected by cautionary object selection portion 24. Thereby, in, for example the road state shown in FIG. 2, for vehicle model 70A, a set of traffic lights, preceding vehicle 70B, oncoming vehicle 70C, and pedestrian w are selected as cautionary objects which should be heeded when driving on a road, and a traffic light movement range calculation rule program, an oncoming vehicle movement range calculation rule program, a preceding vehicle movement range calculation rule program and a pedestrian movement range calculation rule program are read.

In the next step S24, each read movement range calculation rule program is implemented by respective corresponding movement range calculation portions 30, and a selectable movement range is calculated for each cautionary object.

Figure 12:
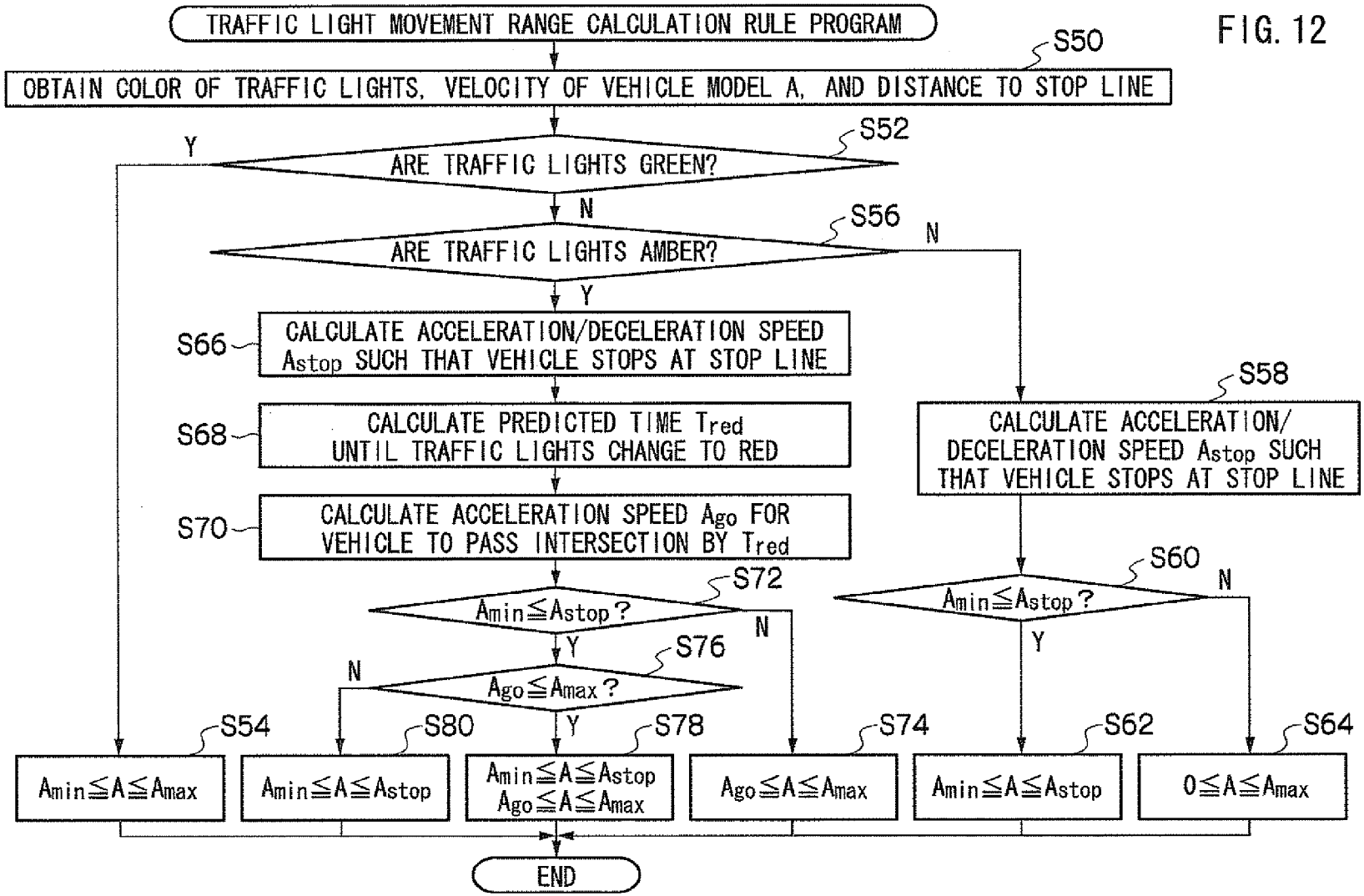
FIG. 12 is a flowchart showing the flow of processing of a traffic light movement range calculation rule program according to the present embodiment.

FIG. 12 shows the flow of processing of a traffic light movement range calculation rule program.

In step S50, based on space arrangement data stored in space arrangement data storage portion 14, the color of a set of traffic lights, the velocity V of vehicle model 70A, and the distance $L_{stop}$ from vehicle model 70A to a stop line, are obtained.

In the next step S52, it is determined whether or not the obtained color of the traffic lights is green. If the traffic lights are green, the processing proceeds to step S54, and if the traffic lights are not green, the processing proceeds to step S56.

In step S54, since the traffic lights are green, and since vehicle model 70A can pass over the crossroads at any velocity, the selectable range of acceleration/deceleration speed A of vehicle model 70A is calculated to be a range from the maximum deceleration speed $A_{min}$ to the maximum acceleration speed $A_{max}$ of vehicle model 70A.

In step S56, it is determined whether or not the obtained color of the traffic lights is amber. If the traffic lights are amber, the processing proceeds to step S66, and if the traffic lights are not amber, the processing proceeds to step S58.

In step S58, since the traffic lights are red, acceleration/deceleration speed $A_{stop}$ is calculated to stop vehicle model 70A at a stop line.

Here, supposing the time for vehicle model 70A to complete acceleration or deceleration to be $T_{acc}$, the acceleration/deceleration speed $A_{stop}$ for stopping the vehicle model 70A at a stop line is calculated according to the following formula (1).

$$A_{stop}=-V/T_{acc} \quad \text{Formula (1)}$$

Thus, if $A_{stop}$ or less is selected as the acceleration/deceleration speed A of vehicle model 70A, vehicle model 70A can be stopped at the stop line.

In the next step S60, it is determined whether acceleration/deceleration speed $A_{stop}$ obtained according to the above Formula (1) is equal to or greater than maximum deceleration speed $A_{min}$ of vehicle model 70A. If $A_{stop}$ is equal to or greater than $A_{min}$, the processing proceeds to step S62. If $A_{stop}$ is less than $A_{min}$, the processing proceeds to step S64.

In step S62, in order to stop vehicle model 70A at the stop line, the selectable range of acceleration/deceleration speed A of vehicle model 70A is calculated to be the range from the maximum deceleration speed $A_{min}$ of vehicle model 70A to acceleration/deceleration speed $A_{stop}$.

In step S64, since it is not possible to stop vehicle model 70A at the stop line, in order to cause vehicle model 70A to pass quickly across the intersection, the selectable range of acceleration/deceleration speed A of vehicle model 70A is calculated to be within a range from 0 to the maximum acceleration speed $A_{max}$.

In step S66, similar to step S58, an acceleration/deceleration speed $A_{stop}$ of vehicle model 70A such that it stops at the stop line is calculated according to Formula (1) above.

In the next step S68, a predicted time $T_{red}$ at which the color of the traffic lights changes from amber to red is calculated. Predicted time Tred may be calculated by subtracting the time which has passed since the traffic lights changed to amber from the time it takes for the traffic lights to change from amber to red. Predicted time $T_{red}$ may also be a predetermined time (for example, 2 seconds).

In the next step S70, conditions for vehicle model 70A to pass the stop line by predicted time $T_{red}$ are obtained. A velocity Va for vehicle model 70A to pass the stop line within predicted time $T_{red}$ is calculated according to Formula (2) below.

$$Va=L_{stop}/T_{red} \quad \text{Formula (2)}$$

As stated above, assuming that the acceleration or deceleration of vehicle model 70A is to be completed by time $T_{acc}$, an acceleration/deceleration speed $A_{go}$, for causing vehicle model 70A to pass a stop line and turn right before the color of a set of traffic lights changes to red, is obtained according to the following Formula (3).

$$A_{go}=(Va-V)/T_{acc} \quad \text{Formula (3)}$$

Thus, if the acceleration/deceleration speed A of vehicle model 70A is selected such that it is above acceleration/deceleration speed $A_{go}$, vehicle model 70A can pass a stop line and turn right at an intersection before the color of a set of traffic lights changes to red.

In the next step S72, it is determined whether acceleration/deceleration speed $A_{stop}$ determined in step S66 is equal to or greater than maximum deceleration speed $A_{min}$ of vehicle model 70A. If $A_{stop}$ is equal to or greater than $A_{min}$, the processing proceeds to step S76. If $A_{stop}$ is less than $A_{min}$, the processing proceeds to step S74.

In step S74, since it is not possible to stop vehicle model 70A at the stop line, in order to cause vehicle model 70A to pass quickly across the intersection, the selectable range of acceleration/deceleration speed A of vehicle model 70A is calculated to be within a range from acceleration/deceleration speed $A_{go}$ to maximum acceleration speed $A_{max}$.

In step S76, it is determined whether acceleration/deceleration speed $A_{go}$ obtained in step S70 is equal to or less than the maximum acceleration speed $A_{max}$ of vehicle model 70A. If $A_{go}$ is equal to or less than $A_{max}$, the processing proceeds to step S78. If $A_{go}$ is greater than $A_{max}$, the processing proceeds to step S80.

In step S78, since vehicle model 70A can both pass a stop line before the color of a set of traffic lights changes to red, and stop at the stop line, the selectable range of acceleration/deceleration speed A of vehicle model 70A is calculated to be within a range from maximum deceleration speed $A_{min}$ to acceleration/deceleration speed $A_{stop}$, as well as within a range from acceleration/deceleration speed $A_{go}$ to maximum acceleration speed $A_{max}$.

In step S80, in order to stop vehicle model 70A at a stop line, the selectable range of acceleration/deceleration speed A of vehicle model 70A is calculated to be within a range from maximum deceleration speed $A_{min}$ to acceleration/deceleration speed $A_{stop}$.

The present traffic light movement range calculation rule program ends processing once the selectable range of acceleration/deceleration speed A of vehicle model 70A has been calculated.

Figure 13:
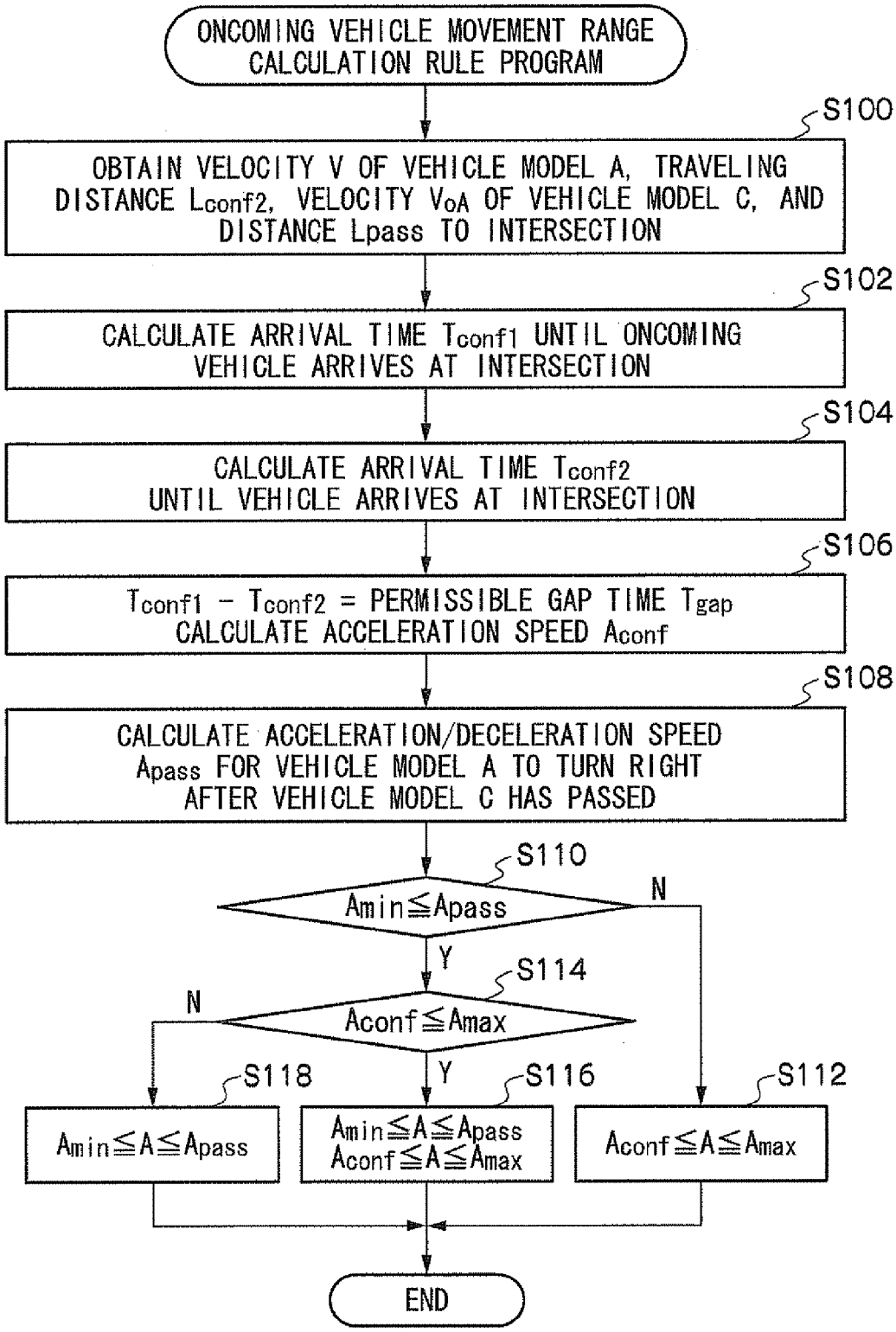
FIG. 13 is a flowchart showing the flow of processing of an oncoming vehicle movement range calculation rule program according to the present embodiment.

FIG. 13 shows the flow of processing of an oncoming vehicle movement range calculation rule program.

In step S100, a velocity V of vehicle model 70A, a traveling distance $L_{conf2}$ from vehicle model 70A to a position at which vehicle model 70A turns right at an intersection and navigates through the intersection, a velocity $V_{OA}$ of vehicle model 70C, a distance $L_{conf1}$ from vehicle model 70C to the intersection, and a distance $L_{pass}$ from vehicle model 70C to a position at which vehicle model 70C passes through the intersection, are obtained from space arrangement data stored in space arrangement data storage portion 14.

In the next step S102, an arrival time $T_{conf1}$ until vehicle model 700 arrives at the intersection, is calculated from the velocity $V_{OA}$ of vehicle model 70C and the distance $L_{conf1}$ from vehicle model 70C to the intersection, according to Formula (4) below.

$$T_{conf1}=L_{conf1}/V_{OA} \quad \text{Formula (4)}$$

In the next step S104, an arrival time $T_{conf2}$ until vehicle model 70A turns right at the intersection and navigates through the intersection, is calculated from the velocity V of vehicle model 70A and the distance $L_{conf2}$ from vehicle model 70A to a position at which vehicle model 70A turns right at the intersection and navigates through the intersection, according to Formula (5).

$$T_{conf2}=L_{conf2}/V \quad \text{Formula (5)}$$

In the next step S106, conditions are obtained for a case in which vehicle model 70A passes in front of vehicle model 70C and turns right. If the gap in arrival times to the intersection of vehicle model 70A and vehicle model 70C is equal to or less than a predetermined gap time $T_{gap}$, and vehicle model 70A can pass in front of vehicle model 70C and turn right, then vehicle model 70A may navigate through the intersection within a time from the present time to $(T_{conf1}-T_{gap})$. If vehicle model 70A can navigate through the intersection by $(T_{conf1}-T_{gap})$, then, assuming the acceleration/deceleration speed of vehicle model 70A to be $A_{conf}$ in a case in which it passes in front of vehicle model 70C and turns right, then a distance $L_{conf2}$ from vehicle model 70A to a position at which it turns right at the intersection and navigates through the intersection is obtained according to the following Formula (6).

Formula (6)

$$V\times(T_{CONF1}-T_{gap})+\frac{1}{2}\times A_{conf}\times(T_{CONF1}-T_{gap})^2=L_{conf2} \quad (6)$$

Accordingly, acceleration/deceleration speed $A_{conf}$ may be obtained according to the following Formula (7).

Formula (7)

$$A_{conf}=\frac{2}{(T_{CONF1}-T_{gap})^2}\times\{L_{conf2}-V\times(T_{CONF1}-T_{gap})\} \quad (7)$$

If an acceleration/deceleration speed A of vehicle model 70A is selected to be equal to or greater than acceleration/deceleration speed $A_{conf}$, then vehicle model 70A can pass in front of vehicle model 70C and turn right at the intersection.

In the next step S108, conditions are obtained for a case in which vehicle model 70A turns right at the intersection after vehicle model 70C has passed through the intersection. The time at which vehicle model 70C passes through the intersection is obtained as $L_{pass}/V_{OA}$. Accordingly, assuming vehicle model 70A is to turn right after vehicle model 70C passes through the intersection, vehicle model 70A may navigate through the intersection at any time after $(L_{pass}/V_{OA}+T_{gap})$, after the present time. Assuming that vehicle model 70A can navigate through the intersection following $(L_{pass}/V_{OA}+T_{gap})$, then, assuming $A_{pass}$ to be an acceleration/deceleration speed for turning right through the intersection after vehicle model 70C has passed through the intersection, distance $L_{conf2}$ from vehicle model 70A to a position at which vehicle model 70A turns right through the intersection is obtained according to the following Formula (8).

Formula (8)

$$V\times\left(\frac{L_{pass}}{V_{OA}}+T_{gap}\right)+\frac{1}{2}\times A_{pass}\times\left(\frac{L_{pass}}{V_{OA}}+T_{gap}\right)^2=L_{conf2} \quad (8)$$

Accordingly, acceleration/deceleration speed $A_{pass}$ may be obtained by the following Formula (9).

Formula (9)

$$A_{pass}=\frac{2}{\left(\frac{L_{pass}}{V_{OA}}+T_{gap}\right)^2}\times\left\{L_{conf2}-V\times\left(\frac{L_{pass}}{V_{OA}}+T_{gap}\right)\right\} \quad (9)$$

Thus, if acceleration/deceleration speed A of vehicle model 70A is selected to be equal to or less than acceleration/deceleration speed $A_{pass}$, vehicle model 70A can turn right at the intersection after vehicle model 70C has passed through the intersection.

In the next step S110 it is determined whether acceleration/deceleration speed $A_{pass}$ is equal to or greater than the maximum deceleration speed $A_{min}$ of vehicle model 70A. If $A_{pass}$ is equal to or greater than $A_{min}$, the processing proceeds to step S114, and if $A_{pass}$ is less than $A_{min}$, the processing proceeds to step S112.

In the next step S112, since vehicle model 70A is unable to turn right after vehicle model 70C has passed through the intersection, in order to make vehicle model 70A pass in front of vehicle model 70C quickly, the selectable range of acceleration/deceleration speed A of vehicle model 70A is calculated to be within a range from acceleration/deceleration speed $A_{conf}$ to maximum acceleration speed $A_{max}$.

In step S114, it is determined whether acceleration/deceleration speed $A_{conf}$ is equal to or less than maximum acceleration speed $A_{max}$ of vehicle model 70A. If $A_{conf}$ is equal to or less than $A_{max}$, the processing proceeds to step S116, and if $A_{conf}$ is less than $A_{max}$, the processing proceeds to step S118.

In step S116, since vehicle model 70A can pass in front of vehicle model 70C and turn right at the intersection, and vehicle model 70A can also turn right at the intersection after vehicle model 70C has passed the intersection, acceleration/deceleration speed A of vehicle model 70A is calculated to be within a range from maximum deceleration $A_{min}$ to acceleration/deceleration speed $A_{pass}$, and also within a range from acceleration/deceleration speed $A_{conf}$ to maximum acceleration speed $A_{max}$.

In step S118, in order to make vehicle model 70A turn right at the intersection after vehicle model 70C has passed the intersection, the selectable range of acceleration/deceleration speed A of vehicle model 70A is calculated to be within a range from maximum deceleration $A_{min}$ to acceleration/deceleration speed $A_{pass}$.

The oncoming vehicle movement range calculation rule program ends processing once the selectable range of acceleration/deceleration speed A of vehicle model 70A has been calculated.

Figure 14:
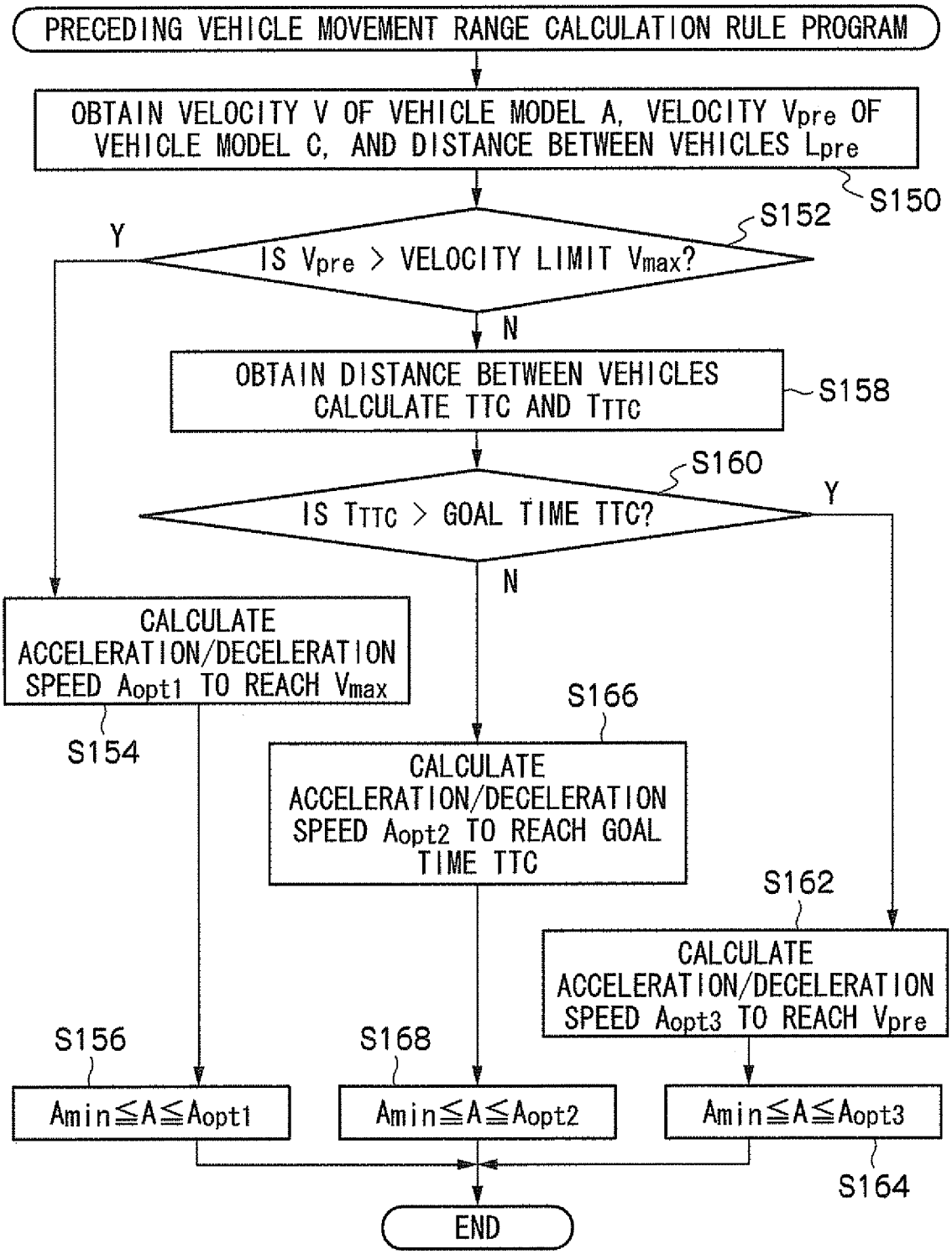
FIG. 14 is a flowchart showing the flow of processing of a preceding vehicle movement range calculation rule program according to the present embodiment.

FIG. 14 shows the flow of processing of a preceding vehicle movement range calculation rule program.

In step S150, a velocity V of vehicle model 70A, a velocity $V_{pre}$ of preceding vehicle model 70B and a distance $L_{pre}$ from vehicle model 70A to vehicle model 70B are obtained from space arrangement data stored in space arrangement data storage portion 14.

In the next step S152, it is determined whether velocity $V_{pre}$ of vehicle model 70B is greater than a velocity limit $V_{max}$. If $V_{pre}$ is greater than $V_{max}$, the processing proceeds to step S154, and if $V_{pre}$ is not greater than $V_{max}$, the processing proceeds to step S158.

In step S154, conditions are obtained for bringing the velocity V of vehicle model 70A to velocity limit $V_{max}$.

As described above, if the acceleration or deceleration of vehicle model 70A is completed by time $T_{acc}$, acceleration/deceleration speed $A_{opt1}$, when velocity V of vehicle model 70A is to be brought to velocity limit $V_{max}$, is calculated according to the following Formula (10).

$$A_{opt1}=(V_{max}-V)/T_{acc} \quad \text{Formula (10)}$$

In the next step S156, in order to bring velocity V of vehicle model 70A to velocity limit $V_{max}$, the selectable range of acceleration/deceleration speed A of vehicle model 70A is calculated to be from maximum deceleration speed $A_{min}$ to acceleration/deceleration speed $A_{opt1}$.

In step S158, based on velocity V of vehicle model 70A and the distance between vehicles $L_{pre}$, a time $T_{TTC}$ taken for vehicle model 70A to cover distance $L_{pre}$ is calculated according to Formula (11).

$$T_{TTC}=L_{pre}/V \quad \text{Formula (11)}$$

In the next step S160, based on a predetermined reference time TC, which represents an appropriate gap between vehicles traveling in the same direction, and a driver's level of concentration, a goal time TTC is calculated according to the following Formula 12.

$$TTC=TC\times(1.0/\text{level of concentration}) \quad \text{Formula (12)}$$

In this way, by changing the goal time TTC according to the level of concentration of a driver, traffic simulator 10 according to the present embodiment can reproduce a situation in which, for example, a driver increases the space between their vehicle and other vehicles when the level of concentration of the driver decreases.

In step S160, it is determined whether time TTC calculated in step S158 is greater than goal time TTC. If $T_{TTC}$ is greater than TTC, the processing proceeds to step S162. If $T_{TTC}$ is not greater than TTC, the processing proceeds to step S166.

In step S162, conditions for changing velocity V of vehicle model 70A to a velocity $V_{pre}$ of vehicle model 70B are obtained.

As described above, if the acceleration or deceleration of vehicle model 70A is completed by time $T_{acc}$, acceleration/deceleration speed $A_{opt3}$, for when velocity V of vehicle model 70A is to be changed to velocity $V_{pre}$ of vehicle model 70B, is calculated according to the following Formula (13).

$$A_{opt3}=(V_{pre}-V)/T_{acc} \quad \text{Formula (13)}$$

In the next step S164, in order to change velocity V of vehicle model 70A to velocity $V_{pre}$ of vehicle model 70B, the selectable range of acceleration/deceleration speed A of vehicle model 70A is calculated to be within a range from maximum deceleration speed $A_{min}$ to acceleration/deceleration speed $A_{opt3}$.

In step S166, conditions are obtained for changing the velocity V of vehicle model 70A such that the time $T_{TTC}$ taken for vehicle model 70A to cover distance $L_{pre}$ between vehicles becomes goal time TTC.

A velocity $V_{TTC}$ of vehicle model 70A such that that the time $T_{TTC}$ taken for vehicle model 70A to cover distance $L_{pre}$ between vehicles becomes goal time TTC is calculated according to the following Formula (14).

$$V_{TTC}=L_{pre}/TTC \quad \text{Formula (14)}$$

As described above, if acceleration or deceleration of vehicle model 70A is completed by time $T_{acc}$, acceleration/deceleration speed $A_{opt2}$ for when the velocity of vehicle model 70A is changed to velocity $V_{TTC}$, is calculated according to the following Formula (15).

$$A_{opt2}=(A_{TTC}-V)/T_{acc} \quad \text{Formula (15)}$$

In the next step S164, in order to change the velocity of vehicle model 70A to velocity $V_{TTC}$, the selectable range of acceleration/deceleration speed A of vehicle model 70A is calculated to be within a range from maximum deceleration speed $A_{min}$ to acceleration/deceleration speed $A_{opt2}$.

The preceding vehicle movement range calculation rule program ends processing once the selectable range of acceleration/deceleration speed A of vehicle model 70A has been calculated.

Figure 15:
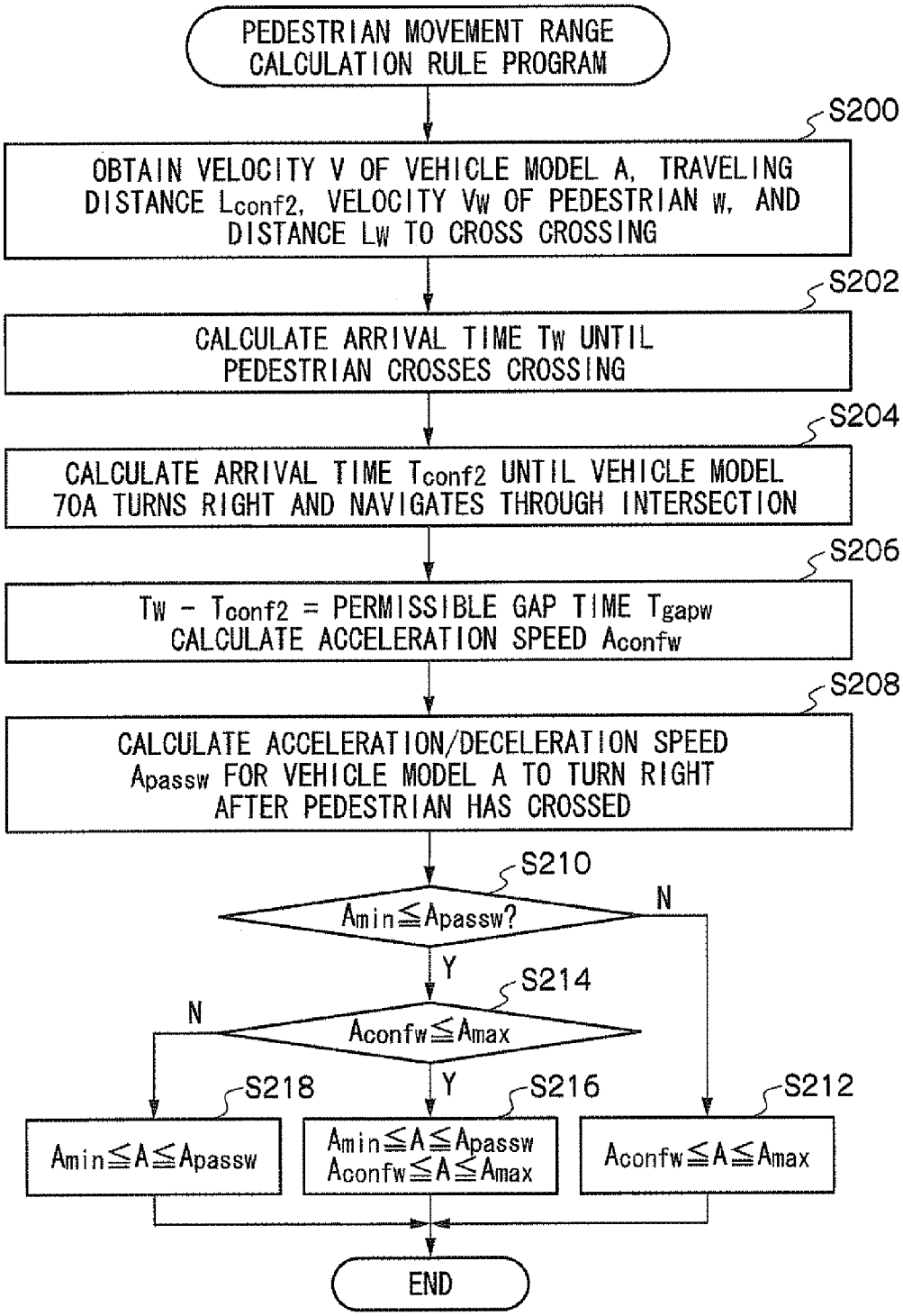
FIG. 15 is a flowchart showing the flow of processing of a pedestrian movement range calculation rule program according to the present embodiment.

FIG. 15 shows the flow of processing of a pedestrian movement range calculation rule program.

In step S200, a velocity V of vehicle model 70A, a distance $L_{conf2}$ from vehicle model 70A until a position at which vehicle model 70A turns right and navigates through an intersection, a velocity $V_w$ of a pedestrian w, and a distance $L_w$ from pedestrian w to a position at which pedestrian w completes crossing of a pedestrian crossing, are obtained from space arrangement data in space arrangement data storage portion 14.

In the next step S202, based on velocity $V_w$ of pedestrian w and distance $L_w$ from pedestrian w to a position at which pedestrian w completes crossing a pedestrian crossing, an arrival time $T_w$ at which pedestrian w has completed crossing the pedestrian crossing is calculated according to Formula (16).

$$T_w = L_w / V_w \quad \text{Formula (16)}$$

In the next step S204, based on velocity V of vehicle model 70A, and distance $L_{conf2}$ from vehicle model 70A to a position at which vehicle model 70A turns right and navigates through an intersection, an arrival time $T_{conf2}$, which represents the time at which vehicle model 70A turns right and navigates through the intersection, is calculated.

In the next step S206, conditions for vehicle model 70A to pass in front of pedestrian w and turn right are obtained. If the gap between the respective arrival times at an intersection of vehicle model 70A and pedestrian w is equal to or greater than a predetermined gap time $T_{gap}$, and vehicle model 70A can pass in front of pedestrian w and turn right, then vehicle model 70A may navigate through the intersection within a time from the present time to $(T_w - T_{gapw})$. If vehicle model 70A can navigate through the intersection by $(T_w - T_{gapw})$, then, assuming the acceleration/deceleration speed of vehicle model 70A to be $A_{confw}$ in a case in which it passes in front of pedestrian w and turns right, then a distance $L_{conf2}$ from vehicle model 70A to a position at which vehicle model 70A turns right and navigates through the intersection may be obtained according to the following Formula (17).

Formula (17)

$$V \times (T_W - T_{gapw}) + \frac{1}{2} \times A_{confw} \times (T_W - T_{gapw})^2 = L_{conf2} \quad (17)$$

Accordingly, acceleration/deceleration speed $A_{confw}$ may be obtained according to the following Formula (18).

Formula (18)

$$A_{confw} = \frac{2}{(T_W - T_{gapw})^2} \times \{L_{conf2} - V \times (T_W - T_{gapw})\} \quad (18)$$

If an acceleration/deceleration speed A of vehicle model 70A can be selected such that it is equal to or greater than acceleration/deceleration speed $A_{confw}$, then vehicle model 70A can pass in front of pedestrian w and turn right at the intersection.

In the next step S208, conditions are obtained for a case in which vehicle model 70A turns right at the intersection after pedestrian w has completed crossing the intersection. The time at which pedestrian w has crossed the intersection is obtained as $L_w/V_w$. Accordingly, if vehicle model 70A is to turn right after pedestrian w has crossed, vehicle model 70A may navigate through the intersection at any time after $(L_w/V_w + T_{gapw})$ after the present time. If vehicle model 70A can navigate through the intersection following $(L_w/V_w + T_{gapw})$, then, assuming an acceleration/deceleration speed for turning right through the intersection after the pedestrian has crossed to be $A_{passw}$, distance $L_{conf2}$ from vehicle model 70A to a position at which vehicle model 70A turns right through the intersection is obtained according to the following Formula (19).

Formula (19)

$$V \times \left(\frac{L_W}{V_W} + T_{gapw}\right) + \frac{1}{2} \times A_{passw} \times \left(\frac{L_W}{V_W} + T_{gapw}\right)^2 = L_{conf2} \quad (19)$$

Accordingly, acceleration/deceleration speed $A_{passw}$ is obtained by the following Formula (20).

Formula (20)

$$A_{passw} = \frac{2}{\left(\frac{L_W}{V_W} + T_{gapw}\right)^2} \times \left\{L_{conf2} - V \times \left(\frac{L_W}{V_W} + T_{gapw}\right)\right\} \quad (20)$$

Thus, if acceleration/deceleration speed A of vehicle model 70A can be selected such that it is equal to or less than acceleration/deceleration speed $A_{passw}$, vehicle model 70A can turn right at the intersection after pedestrian w has crossed the intersection.

In the next step S210, it is determined whether acceleration/deceleration speed $A_{passw}$ is equal to or greater than the maximum deceleration $A_{min}$ of vehicle model 70A. If $A_{passw}$ is equal to or greater than $A_{min}$, the processing proceeds to step S214, and if $A_{passw}$ is less than $A_{min}$, the processing proceeds to step S212.

In the next step S212, since vehicle model 70A is unable to turn right after pedestrian w has crossed the intersection, in order to make vehicle model 70A pass in front of pedestrian w quickly, the selectable range of acceleration/deceleration speed A of vehicle model 70A is calculated to be within a range from acceleration/deceleration speed $A_{confw}$ to maximum acceleration speed $A_{max}$.

In step S214, it is determined whether acceleration/deceleration speed $A_{confw}$ is equal to or less than maximum acceleration speed $A_{max}$ of vehicle model 70A. If $A_{confw}$ is equal to or less than $A_{max}$, the processing proceeds to step S216, and if $A_{confw}$ is greater than $A_{max}$, the processing proceeds to step S218.

In step S216, since vehicle model 70A can pass in front of pedestrian w and turn right at the intersection, and vehicle model 70A can also turn right at the intersection after pedestrian w has crossed the intersection, acceleration/deceleration speed A of vehicle model 70A is calculated to be within a range from maximum deceleration $A_{min}$ to acceleration/deceleration speed $A_{passw}$, as well as within a range from acceleration/deceleration speed $A_{confw}$ to maximum acceleration speed $A_{max}$.

In step S218, in order to make vehicle model 70A turn right at the intersection after pedestrian w has crossed the intersection, acceleration/deceleration speed A of vehicle model 70A is calculated to be within a range from maximum deceleration $A_{min}$ to acceleration/deceleration speed $A_{passw}$.

The pedestrian movement range calculation rule program ends processing once the selectable range of acceleration/deceleration speed A of vehicle model 70A has been calculated.

Thus, in step S24 as shown in FIG. 7, each read movement range calculation rule program is implemented and a selectable range of acceleration/deceleration speed A of vehicle model 70A is calculated with respect to each cautionary object.

In the next step S26, movement range aggregation portion 40 aggregates the selectable ranges of acceleration/deceleration speed A obtained by each movement range calculation rule program, and obtains a superposed acceleration/deceleration speed range from the plural acceleration/deceleration speed ranges.

Figure 16:
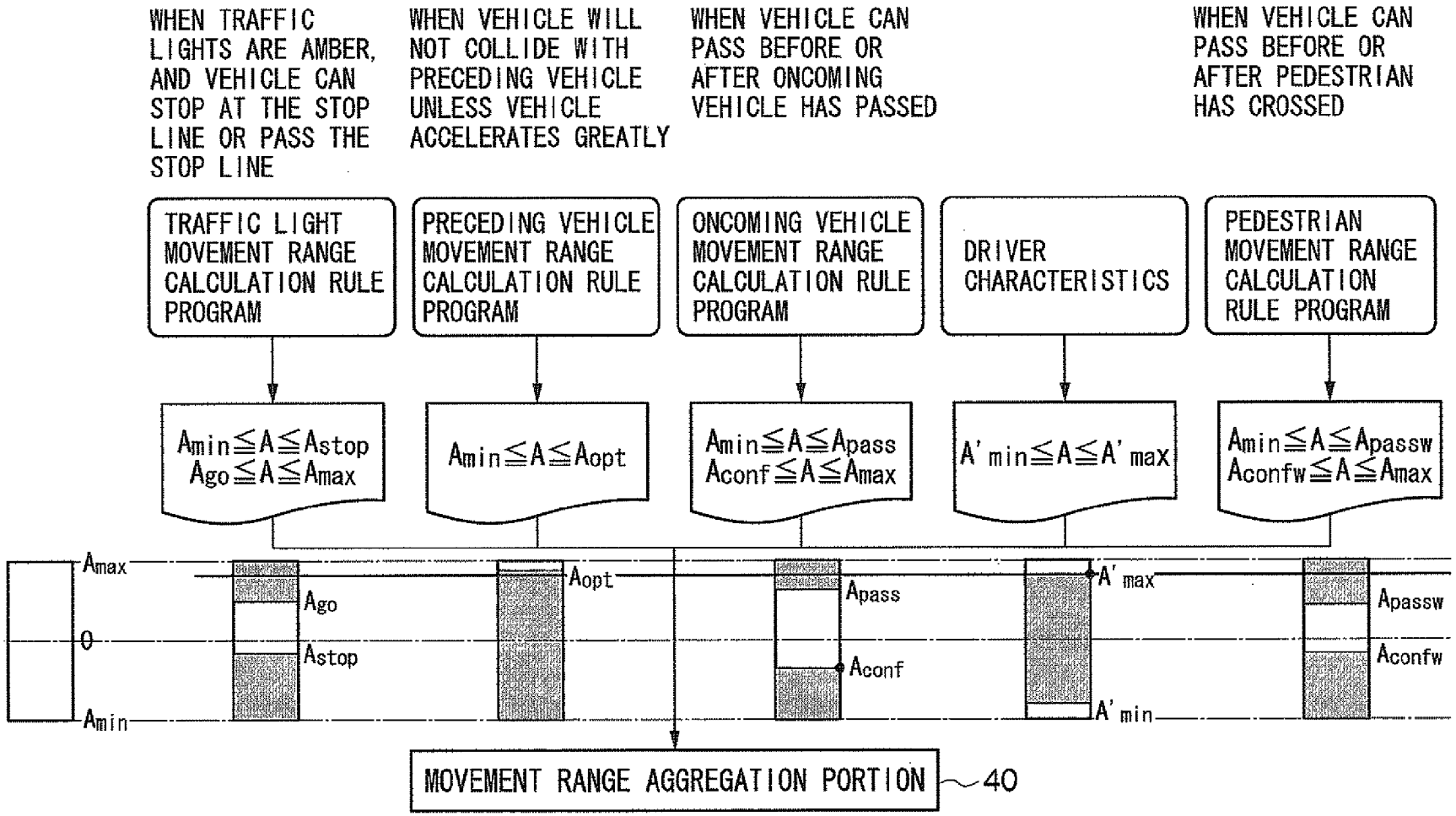
FIG. 16 is a drawing showing schematically the result of aggregated selectable movement ranges.

FIG. 16 shows, schematically, ranges for acceleration/deceleration speed A calculated by each movement range calculation rule program. In this figure, the shaded portions indicate the selectable ranges for acceleration/deceleration speeds A. Thus, for example, the selectable acceleration/deceleration speed A which has been determined with respect to the set of traffic lights is from maximum deceleration speed $A_{min}$ to acceleration/deceleration speed $A_{stop}$, as well as from acceleration/deceleration speed $A_{go}$ to maximum acceleration speed $A_{max}$.

In step S28, movement determination portion 42 sets vehicle model 70A to move at the highest acceleration/deceleration speed within the range of the superposed acceleration/deceleration speeds obtained in step S18. For example, if the ranges of selectable acceleration/deceleration speed A are as shown in FIG. 16, the acceleration/deceleration speed of vehicle model 70A is set to acceleration/deceleration speed $A'_{max}$.

In step S30, behavior calculation portion 44 calculates a position to which vehicle model 70A is moved, at the acceleration/deceleration speed of vehicle model 70A set in step S28, only for a processing interval of a single instance of a repeating process from step S12 above to step S32 (described below), thereby calculating the behavior of vehicle model 70A, and updates space arrangement data in space arrangement data storage portion 14 such that vehicle model 70A moves to the calculated position.

In the next step S32, it is determined whether or not an instruction has been made to end the simulation by an operation portion (not shown). If an instruction has not been given, the processing returns to step S12. If an instruction has been given, processing of the simulation ends at that point.

As described above, cautionary object searching portion 60 searches for cautionary objects which a driver should heed when driving a vehicle model; recognized cautionary object selection portion 64 and driver-recognized cautionary object selection portion 68, based on driver ability information set by data creation portion 13, select cautionary objects recognized by a driver from the found cautionary objects; and movement determination portion 42 determines the movement of a vehicle model based on the selected cautionary objects; thus, a traffic simulator having high accuracy can be achieved.

Further, in the present embodiment, recognized cautionary object selection portion 64 selects from the searched cautionary objects, as cautionary objects recognized by a driver, cautionary objects having a required level of proficiency lower than the level of proficiency of the driver, the required level of proficiency being based on at least one of the distance between a vehicle model and a cautionary object, whether the cautionary object is blocked, and the field of view of the driver with respect to the cautionary object, which are each indicated by the required level of proficiency information stored in required level of proficiency information storage portion 62. Thereby, it is possible to reproduce a state of recognition of cautionary objects of a driver according to the level of driving proficiency of the driver.

In the present embodiment, driver-recognized cautionary object selection portion 68, based on recognition time information stored in recognition time information storage portion 66, obtains required times for a driver to recognize cautionary objects according at least one of the eyesight and level of concentration of the driver, adds the required times together in a predetermined priority order, and selects, as cautionary objects recognized by a driver, those cautionary objects which are added within a predetermined movement determination time necessary to recognize the existence of each cautionary object and determine the movement of a vehicle model. Thereby, it is possible to reproduce a state of recognition of cautionary objects of a driver according to the eyesight or level of concentration of the driver.

In the present embodiment a case has been described in which a program is used to obtain rule information. However, the present invention is not limited thereby, and, for example, a lookup table that stores values representing movement, according to parameters necessary for calculation of a movement range, may also be used. In such a case, the same effects as those of the present embodiment may be achieved.

Figure 17:
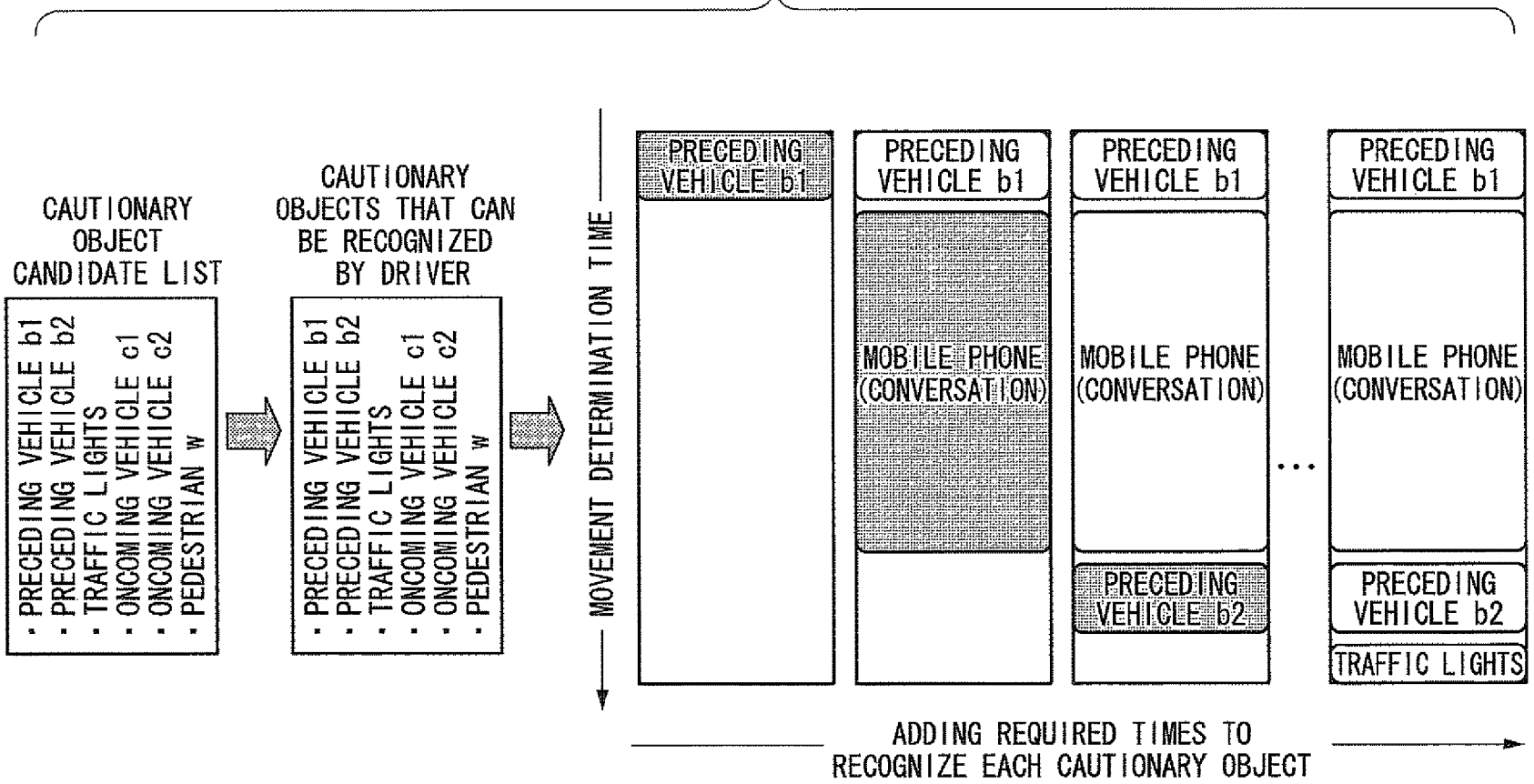
FIG. 17 is a schematic view that accompanies an explanation of the flow of processing when a cautionary object recognized by a driver who is talking on a mobile phone is selected.
Figure 18:
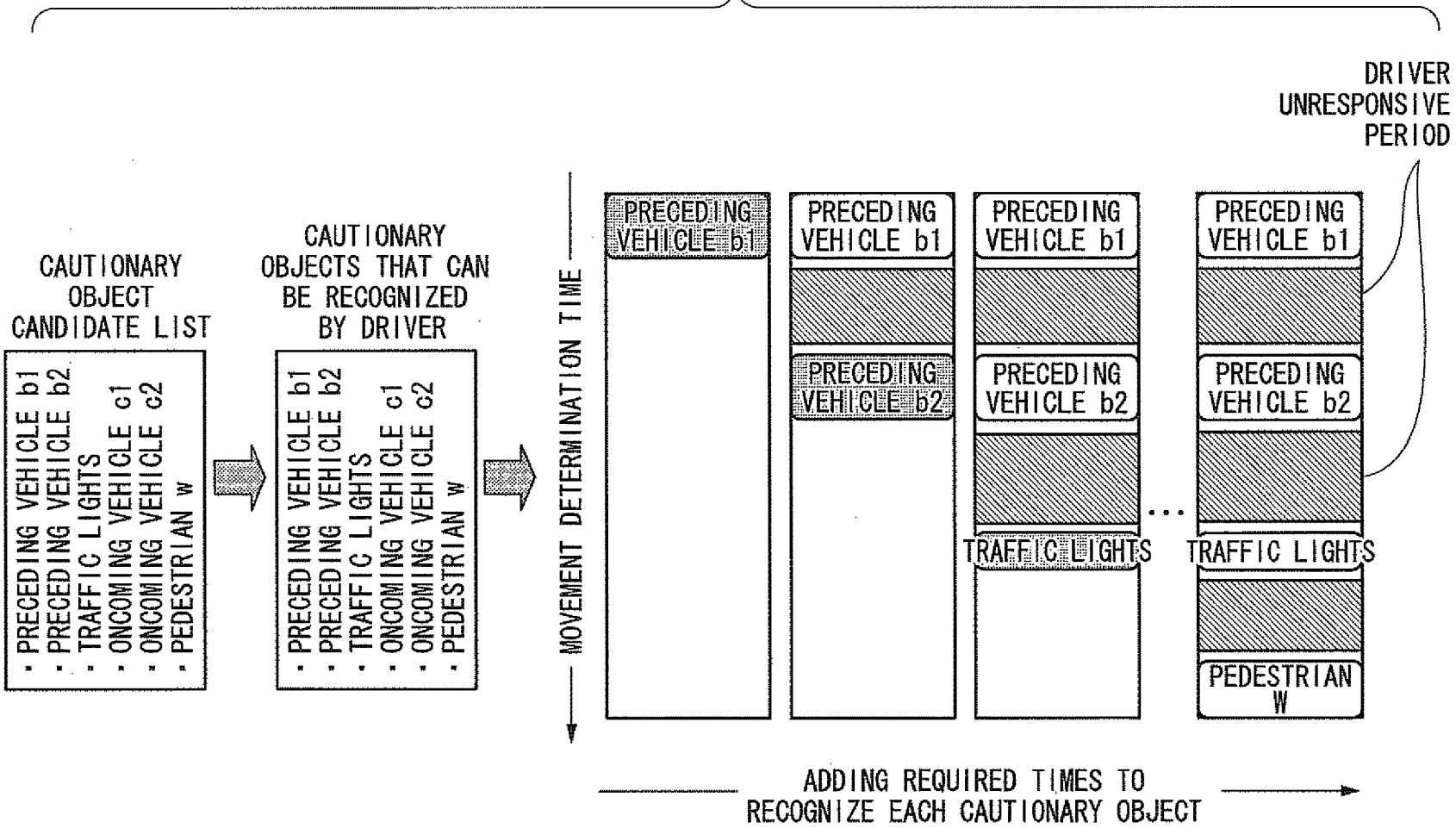
FIG. 18 is a schematic view that accompanies an explanation of the flow of processing when a cautionary object recognized by a driver who is driving carelessly is selected.

In the present embodiment, description has been made of a case in which cautionary objects on a road are recognized according to a driver's ability and movement of a vehicle is determined. However, the present invention is not limited thereby, and, for example, traffic simulator 10 may reproduce a situation in which a driver is driving while talking on a mobile phone, where, for example, as shown in FIG. 17, a certain amount of movement determination time may be taken up as a result of reduced awareness due to talking on a mobile phone, and cautionary objects that fall within the remaining time may be selected as cautionary objects recognized by a driver. Traffic simulator 10 may also reproduce a situation in which a driver is driving carelessly, where, for example, as shown in FIG. 18, a non-reaction time may be added to the time taken to recognize each cautionary object, and cautionary objects that fall within the remaining movement determination time may be selected as cautionary objects recognized by a driver. Thereby, it is possible to simulate accurately the movement of a vehicle driven by a driver who is operating a mobile phone, or who is driving carelessly.

In the present embodiment, a case has been described in which simulation processing has been implemented by hardware. However, the present invention is not limited thereby, and, for example, it may be implemented by software. In this case, the processing implemented in the flowchart shown in FIG. 7 may be created as a computer program and implemented accordingly as an embodiment of the invention. The effects of the present embodiment may also be achieved in this case.

The configuration of traffic simulator 10 (see FIG. 1) explained in the present embodiment, and the configuration of cautionary object selection portion 24 (see FIG. 3) are examples, and may be modified as appropriate provided they do not depart from the gist of the present invention.

The data structure of information described in the present embodiment (see FIGS. 4-6) are also examples, and may be modified as appropriate provided they do not depart from the gist of the present invention.

The flow of the simulation processing (see FIG. 7) described in the present embodiment, and the flow of processing of each movement range calculation rule program (see FIGS. 12-15) are also examples, and may be modified as appropriate provided they do not depart from the gist of the present invention.

REFERENCE NUMERALS

10 Traffic simulator
13 Data creation portion (setting portion)
14 Space arrangement data storage portion (storage portion)
42 Movement determination portion (determination portion)
60 Cautionary object searching portion (searching portion)
62 Required level of proficiency information storage portion (storage portion)

64 Recognized cautionary object selection portion (selection portion)

66 Recognition time information storage portion (storage portion)

68 Driver-recognized cautionary object selection portion (selection portion)

69 Leeway calculation portion (modification portion)

What is claimed is:

1. A traffic simulator, comprising: a setting portion that, when a vehicle model, which is a model of a vehicle, is virtually driven on a road and traffic conditions are simulated, sets ability information representing driving abilities of a driver of the vehicle model; a storage portion that stores space arrangement data representing an arrangement of the vehicle model in a virtual road space; a searching portion that searches the road space, which is represented by the space arrangement data stored in the storage portion, for cautionary objects that should be heeded by the driver when driving the vehicle model; a selection portion, using a processor, that selects a plurality of cautionary objects recognized by the driver from the cautionary objects found by the searching portion based on the ability information of the driver set by the setting portion, the selection portion selecting, as the cautionary objects recognized by the driver, the cautionary objects found by the searching portion whose required level of experience for driver recognition, represented by a level of experience information associated with each predetermined cautionary object, is less than or equal to a level of driving experience of the driver included in the ability information of the driver; and a determination portion that calculates a plurality of movement ranges of the vehicle mode, based on the plurality of cautionary objects selected by the selection portion, and determines a movement of the vehicle model based on the plurality of movement ranges, wherein: the ability information further includes at least one of information representing an eyesight ability of the driver or information representing a level of concentration ability of the driver; the storage portion further stores, for each predetermined cautionary object, recognition time information representing a time required for the driver to recognize the cautionary object according to at least one of eyesight ability or level of concentration ability; and the selection portion, based on the recognition time information stored in the storage portion, obtains the time required for the driver to recognize the cautionary object found by the searching portion according to at least one of the eyesight ability or the level of concentration ability of the driver set by the setting portion, adds together the obtained required times in a predetermined order of priority or in a random order, and selects as cautionary objects recognized by a driver those cautionary objects which are added within a movement determination time required for the driver to recognize cautionary objects and for the movement of the vehicle model to be determined.

2. The traffic simulator of claim 1, wherein:

the storage portion further stores, for each predetermined cautionary object, a required level of experience information representing a level of experience required for the driver to recognize each predetermined cautionary object.

3. The traffic simulator of claim 2, wherein:

the required level of experience information represents a level of experience required by the driver to recognize a cautionary object based on at least one of a distance from a vehicle model to the cautionary object, whether the cautionary object is blocked, or whether the cautionary object is within a field of view of the driver; and the selection portion selects, as cautionary objects recognized by the driver, from the cautionary objects found by the searching portion, those cautionary objects having a required level of experience less than or equal to the level of driving experience of the driver set by the setting portion, the required level of experience being based on at least one of the distance from a vehicle model to the cautionary object, whether the cautionary object is blocked, or whether the cautionary object is within the field of view of the driver.

4. The traffic simulator of claim 1, further provided with a modification portion that, by obtaining an amount of the movement determination time that remains after deducting the added obtained required times, obtains a level of leeway of the driving abilities of the driver, and modifies the information representing the level of concentration ability of the driver such that when the driver has a low level of leeway the concentration ability of the driver is decreased accordingly to that extent.

5. The traffic simulator of claim 1, wherein:

the movement ranges include acceleration/deceleration speed ranges; and the determination portion aggregates the plural acceleration/deceleration speed ranges, and determines a highest acceleration/deceleration speed within the range of a superposed acceleration/deceleration speed range as the movement of the vehicle model.

6. The traffic simulator of claim 1, wherein:

the ability information further includes a maximum acceleration speed and a maximum deceleration speed of the driver that drives the vehicle model; and the determination portion determines the movement of the vehicle model based on the maximum acceleration speed, the maximum deceleration speed, and the plurality of movement ranges.

7. A traffic simulator, comprising: a setting portion that, when a vehicle model, which is a model of a vehicle, is virtually driven on a road and traffic conditions are simulated, sets ability information representing abilities related to the driving of a driver of the vehicle model, the ability information including at least one of information representing an eyesight ability of the driver or information representing a level of concentration ability of the driver, a storage portion that stores space arrangement data representing the arrangement of the vehicle model in a virtual road space, and stores for each predetermined cautionary object, recognition time information representing a time required for the driver to recognize the cautionary object according to at least one of the eyesight ability or the level of concentration ability; a searching portion that searches the road space, which is represented by the space arrangement data stored in the storage portion, for cautionary objects that should be heeded by the driver when driving the vehicle model; a selection portion, using a processor, that selects cautionary objects recognized by the driver from the cautionary objects found by the searching portion, based on ability information of the driver set by the setting portion, the selection portion selecting cautionary objects recognized by the driver by comparing a required time for the driver to recognize the cautionary object according to at least one of the eyesight or the level of concentration of the driver included in the ability information of the driver, with a movement determination time required for the driver to recognize the cautionary object and determine a movement direction of the vehicle model, and the selection portion, based on the recognition time information stored in the storage portion, adds together the obtained required times in a predetermined order of priority or in a random order, and selects as cautionary objects recognized by a driver those cautionary objects which are added within a movement determination time required for the driver to recognize cautionary objects and for the movement of the vehicle model to be determined; and a determination portion that determines the movement of the vehicle model based on the cautionary objects selected by the selection portion.

* * * * *